US008540017B2

(12) United States Patent
Ensley et al.

(10) Patent No.: US 8,540,017 B2
(45) **Date of Patent: *Sep. 24, 2013**

(54) METHOD AND SYSTEM FOR SEALING A WELLBORE

(75) Inventors: Eric Trevor Ensley, Cypress, TX (US); Frank Benjamin Springett, Spring, TX (US); James William Weir, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 345 days.

This patent is subject to a terminal disclaimer.

(21) Appl. No.: 12/838,776

(22) Filed: Jul. 19, 2010

(65) Prior Publication Data

US 2012/0012340 A1 Jan. 19, 2012

(51) Int. Cl.
*E21B 33/06* (2006.01)

(52) U.S. Cl.
USPC ..... 166/85.4; 166/84.4; 251/1.1

(58) Field of Classification Search
USPC ..... 166/85.4, 84.3, 84.4; 251/1.1
See application file for complete search history.

(56) References Cited

U.S. PATENT DOCUMENTS

| | | | |
|---|---|---|---|
| 2,178,698 | A | 11/1939 | Penick et al. |
| 2,193,110 | A | 3/1940 | Penick et al. |
| 2,194,256 | A | 3/1940 | Allen |
| 2,231,613 | A | 2/1941 | Burke |
| 2,304,793 | A | 12/1942 | Bodine, Jr. |
| 2,592,197 | A | 4/1952 | Schweitzer |
| 2,752,119 | A | 6/1956 | Allen et al. |
| 3,001,803 | A | 9/1961 | Watts et al. |
| 3,028,917 | A | 4/1962 | Rhodes |
| 3,040,611 | A | 6/1962 | Tournaire |
| 3,242,826 | A | 3/1966 | Smith |
| 3,272,222 | A | 9/1966 | Allen et al. |
| 3,399,728 | A | 9/1968 | Taylor |
| 3,434,729 | A | 3/1969 | Shaffer et al. |

(Continued)

FOREIGN PATENT DOCUMENTS

| | | |
|---|---|---|
| DE | 3516424 | 11/1986 |
| DE | 3317487 | 10/1993 |

(Continued)

OTHER PUBLICATIONS

International Search Report and Written Opinion mailed Jan. 6, 2012 for PCT/US11/42864.

(Continued)

*Primary Examiner* — Frederick L Lagman
(74) *Attorney, Agent, or Firm* — JL Salazar Law Firm

(57) ABSTRACT

Systems and methods for sealing a wellbore are provided. The wellbore has a pipe therein for the passage of fluid therethrough. The system is provided with a BOP positionable about the pipe and at least one seal assembly positionable about the BOP. Each of the seal assemblies has a plurality of blocks positionable within the BOP, at least one actuator for selectively moving the blocks to a contact position surrounding the pipe, and a plurality of pipe seals carried by the blocks for creating a seal about the pipe of the wellbore. Each block has an opening extending into a cavity therein. Each pipe seal is positionable in one of the cavities and flowable through the opening thereof as the blocks are moved into the contact position whereby at least a portion of a pressure applied to the pipe seals is released from the blocks.

36 Claims, 30 Drawing Sheets

(56) References Cited

U.S. PATENT DOCUMENTS 3,554,278 A 1/1971 Reistle, III et al.
3,554,480 A 1/1971 Rowe
3,561,526 A 2/1971 Williams et al.
3,572,628 A 3/1971 Jones
3,647,174 A 3/1972 LeRouax
3,670,761 A 6/1972 LeRouax
3,716,068 A 2/1973 Addison
3,741,296 A 6/1973 Murman et al.
3,744,749 A 7/1973 LeRouax
3,766,979 A 10/1973 Petrick
3,771,601 A 11/1973 Garrett
3,863,667 A 2/1975 Ward
3,871,613 A 3/1975 LeRouax
3,918,478 A 11/1975 LeRouax
3,922,780 A 12/1975 Green
3,941,141 A 3/1976 Robert
3,946,806 A 3/1976 Meynier, III
3,955,622 A 5/1976 Jones
4,007,797 A 2/1977 Jeter
4,007,905 A * 2/1977 Mott ..... 251/1.1
4,043,389 A 8/1977 Cobb
4,052,995 A 10/1977 Ellison
4,057,887 A 11/1977 Jones et al.
4,076,208 A 2/1978 Olson
4,119,115 A 10/1978 Carruthers
4,132,265 A 1/1979 Williams, Jr.
4,132,266 A 1/1979 Olson
4,132,267 A 1/1979 Jones
4,140,041 A 2/1979 Frelau
4,162,057 A 7/1979 Qasim
4,188,860 A 2/1980 Miller
4,192,483 A 3/1980 Combes
4,215,749 A 8/1980 Dare et al.
4,220,206 A 9/1980 Van Winkle
4,229,012 A 10/1980 Williams, III
4,253,638 A 3/1981 Troxell, Jr.
4,265,424 A 5/1981 Jones
4,290,577 A 9/1981 Olson
4,305,565 A 12/1981 Abbe
4,313,496 A 2/1982 Childs et al.
4,323,256 A 4/1982 Miyagishima et al.
4,332,367 A 6/1982 Nelson
4,341,264 A 7/1982 Cox et al.
4,347,898 A 9/1982 Jones
4,372,527 A 2/1983 Rosenhauch et al.
4,392,633 A 7/1983 Van Winkle
4,416,441 A 11/1983 Van Winkle
4,437,643 A 3/1984 Brakhage, Jr. et al.
4,438,900 A 3/1984 Schaeper et al.
4,444,404 A 4/1984 Parks, Jr.
4,456,215 A 6/1984 Bishop et al.
4,492,359 A 1/1985 Baugh
4,502,534 A 3/1985 Roche et al.
4,504,037 A 3/1985 Beam et al.
4,508,311 A 4/1985 Just et al.
4,508,313 A 4/1985 Jones
4,516,598 A 5/1985 Stupak
4,518,144 A 5/1985 Vicic et al.
4,519,577 A 5/1985 Jones
4,523,639 A 6/1985 Howard, Jr.
4,526,339 A 7/1985 Miller
4,537,250 A 8/1985 Troxell, Jr.
4,540,045 A 9/1985 Molitor
4,540,046 A 9/1985 Granger et al.
4,550,895 A 11/1985 Shaffer
4,558,842 A 12/1985 Peil et al.
4,568,842 A 2/1986 Koike
4,582,293 A 4/1986 Jones
4,601,232 A 7/1986 Troxell, Jr.
4,612,983 A 9/1986 Karr, Jr.
4,646,825 A 3/1987 Van Winkle
4,647,002 A 3/1987 Crutchfield
4,655,284 A 4/1987 McIlvride
4,690,033 A 9/1987 Van Winkle
4,690,411 A 9/1987 Van Winkle
4,699,350 A 10/1987 Herve
4,770,387 A 9/1988 Granger
4,840,346 A * 6/1989 Adnyana et al. ..... 251/1.3
4,877,217 A 10/1989 Peil et al.
4,911,410 A 3/1990 Baker
4,922,423 A 5/1990 Koomey et al.
4,923,005 A 5/1990 Laky et al.
4,923,006 A 5/1990 Hartmann et al.
4,923,008 A 5/1990 Wachowicz et al.
4,938,290 A 7/1990 Leggett et al.
4,943,031 A 7/1990 Van Winkle
4,969,390 A 11/1990 Williams, III
4,969,627 A 11/1990 Williams, III
4,997,162 A 3/1991 Baker et al.
5,002,130 A 3/1991 Laky
5,011,110 A 4/1991 Le
5,013,005 A 5/1991 Nance
5,025,708 A 6/1991 Smith et al.
5,056,418 A * 10/1991 Granger et al. ..... 251/1.1
5,063,828 A 11/1991 Kamimura
5,064,164 A 11/1991 Le
5,125,620 A 6/1992 Young
5,150,049 A 9/1992 Schuetz
5,178,215 A 1/1993 Yenulis et al.
5,199,493 A 4/1993 Sodder, Jr.
5,199,683 A 4/1993 Le
5,217,073 A 6/1993 Bruns
5,237,899 A 8/1993 Schartinger
5,255,890 A 10/1993 Morrill
5,320,325 A 6/1994 Young et al.
5,360,061 A 11/1994 Womble
5,361,832 A 11/1994 Van Winkle
5,400,857 A 3/1995 Whitby et al.
5,407,172 A 4/1995 Young et al.
5,501,424 A 3/1996 Williams et al.
5,505,426 A 4/1996 Whitby et al.
5,515,916 A 5/1996 Haley
5,566,753 A 10/1996 Van Winkle et al.
5,575,452 A 11/1996 Whitby et al.
5,588,491 A 12/1996 Brugman et al.
5,590,867 A 1/1997 Van Winkle
5,653,418 A 8/1997 Olson
5,655,745 A 8/1997 Morrill
5,662,171 A 9/1997 Brugman et al.
5,713,581 A 2/1998 Carlson et al.
5,735,502 A 4/1998 Levett et al.
5,775,420 A 7/1998 Mitchell et al.
5,778,918 A 7/1998 McLelland
5,833,208 A 11/1998 Lee, Jr.
5,863,022 A 1/1999 Van Winkle
5,897,074 A 4/1999 Marino
5,897,094 A 4/1999 Brugman et al.
5,918,851 A 7/1999 Whitby
5,944,110 A 8/1999 Watts et al.
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
D425,525 S 5/2000 Wooten
6,089,526 A 7/2000 Olson
6,113,061 A 9/2000 Van Winkle
6,158,505 A 12/2000 Araujo
6,164,619 A 12/2000 Van Winkle et al.
6,173,770 B1 1/2001 Morrill
6,192,680 B1 2/2001 Brugman et al.
6,244,336 B1 6/2001 Kachich
6,244,560 B1 6/2001 Johnson
6,276,450 B1 8/2001 Seneviratne
6,296,225 B1 10/2001 Watts
6,367,804 B1 4/2002 Watts
6,374,925 B1 4/2002 Elkins et al.
6,454,015 B1 9/2002 Armstrong et al.
6,484,808 B2 11/2002 Jones et al.
6,509,733 B2 1/2003 Blubaugh et al.
6,510,895 B1 1/2003 Koleilat et al.
6,510,897 B2 1/2003 Hemphill
6,530,432 B2 3/2003 Gipson
6,554,247 B2 4/2003 Berckenhoff et al.

| | | | | |
|---|---|---|---|---|
| 6,601,650 | B2 | 8/2003 | Sundararajan | |
| 6,718,860 | B2 | 4/2004 | Mitsukawa et al. | |
| 6,719,042 | B2 | 4/2004 | Johnson et al. | |
| 6,742,597 | B2 | 6/2004 | Van Winkle et al. | |
| 6,782,799 | B2 | 8/2004 | Vincent | |
| 6,834,721 | B2 | 12/2004 | Suro | |
| 6,843,463 | B1 | 1/2005 | McWhorter et al. | |
| 6,857,634 | B2 | 2/2005 | Araujo | |
| 6,877,712 | B2 | 4/2005 | Wiedemann | |
| 6,955,357 | B2 | 10/2005 | Griffin et al. | |
| 6,964,303 | B2 | 11/2005 | Mazorow et al. | |
| 6,969,042 | B2 | 11/2005 | Gaydos | |
| 6,974,135 | B2 | 12/2005 | Melancon et al. | |
| 7,004,444 | B2 | 2/2006 | Kinder | |
| 7,011,159 | B2 | 3/2006 | Holland | |
| 7,011,160 | B2 | 3/2006 | Boyd | |
| 7,023,199 | B2 | 4/2006 | Blubaugh et al. | |
| 7,036,613 | B2 | 5/2006 | Burr | |
| 7,044,430 | B2 | 5/2006 | Brugman et al. | |
| 7,051,989 | B2 | 5/2006 | Springett et al. | |
| 7,051,990 | B2 | 5/2006 | Springett et al. | |
| 7,055,594 | B1 | 6/2006 | Springett et al. | |
| 7,086,467 | B2 | 8/2006 | Schlegelmilch et al. | |
| 7,100,892 | B2 | 9/2006 | Iwabuchi | |
| 7,108,081 | B2 | 9/2006 | Boyadjieff | |
| 7,121,185 | B2 | 10/2006 | Alrefai | |
| 7,125,055 | B2 | 10/2006 | Dallas | |
| 7,159,652 | B2 | 1/2007 | McGuire et al. | |
| 7,165,619 | B2 | 1/2007 | Fox et al. | |
| 7,181,808 | B1 | 2/2007 | Van Winkle | |
| 7,195,224 | B2 | 3/2007 | Le | |
| 7,207,382 | B2 | 4/2007 | Schaeper | |
| 7,216,872 | B1 | 5/2007 | Shaw et al. | |
| 7,225,793 | B2 | 6/2007 | Schwulst et al. | |
| 7,225,873 | B2 | 6/2007 | Schlegelmilch et al. | |
| 7,234,530 | B2 | 6/2007 | Gass | |
| 7,243,713 | B2 | 7/2007 | Isaacks et al. | |
| 7,246,666 | B2 | 7/2007 | Hemphill et al. | |
| 7,270,190 | B2 | 9/2007 | McWhorter et al. | |
| 7,274,989 | B2 | 9/2007 | Hopper | |
| 7,287,544 | B2 | 10/2007 | Seneviratne et al. | |
| 7,331,562 | B2 | 2/2008 | Springett | |
| 7,350,587 | B2 | 4/2008 | Springett et al. | |
| 7,354,026 | B2 | 4/2008 | Urrutia | |
| 7,360,603 | B2 | 4/2008 | Springett et al. | |
| 7,367,396 | B2 | 5/2008 | Springett et al. | |
| 7,389,817 | B2 | 6/2008 | Almdahl et al. | |
| 7,410,003 | B2 | 8/2008 | Ravensbergen et al. | |
| 7,434,369 | B2 | 10/2008 | Uneyama et al. | |
| 7,464,751 | B1 | 12/2008 | Abel | |
| 7,464,765 | B2 | 12/2008 | Isaacks et al. | |
| 7,487,848 | B2 | 2/2009 | Wells et al. | |
| 7,510,002 | B2 | 3/2009 | Brown et al. | |
| 7,520,129 | B2 | 4/2009 | Springett | |
| 7,523,644 | B2 | 4/2009 | Van Winkle | |
| 7,673,674 | B2 | 3/2010 | Lam | |
| 7,703,739 | B2 | 4/2010 | Judge et al. | |
| 7,721,808 | B2 | 5/2010 | Dallas et al. | |
| 7,726,418 | B2 | 6/2010 | Ayling | |
| 7,748,473 | B2 | 7/2010 | Wells et al. | |
| 7,798,466 | B2 | 9/2010 | Springett et al. | |
| 7,832,706 | B2 | 11/2010 | Judge | |
| 7,967,299 | B2 | 6/2011 | McClanahan | |
| 8,066,070 | B2 | 11/2011 | Springett | |
| 2004/0021102 | A1* | 2/2004 | Berckenhoff et al. | 251/1.1 |
| 2004/0021269 | A1 | 2/2004 | Gaudette et al. | |
| 2004/0124380 | A1 | 7/2004 | Van Winkle | |
| 2005/0242519 | A1 | 11/2005 | Koleilat et al. | |
| 2006/0076526 | A1 | 4/2006 | McWhorter et al. | |
| 2006/0144586 | A1 | 7/2006 | Urrutia | |
| 2006/0278406 | A1 | 12/2006 | Judge et al. | |
| 2007/0075288 | A1 | 4/2007 | Matte | |
| 2007/0137688 | A1 | 6/2007 | Yoshida | |
| 2007/0236006 | A1 | 10/2007 | Fultz | |
| 2008/0040070 | A1 | 2/2008 | McClanahan | |
| 2008/0076526 | A1 | 3/2008 | Zhang | |
| 2008/0135791 | A1 | 6/2008 | Juda et al. | |
| 2008/0185046 | A1 | 8/2008 | Springett et al. | |
| 2008/0189954 | A1 | 8/2008 | Lin | |
| 2008/0196888 | A1* | 8/2008 | Judge et al. | 251/1.3 |
| 2008/0265188 | A1 | 10/2008 | Springett et al. | |
| 2008/0267786 | A1 | 10/2008 | Springett et al. | |
| 2008/0286534 | A1 | 11/2008 | Springett et al. | |
| 2009/0056132 | A1 | 3/2009 | Foote | |
| 2009/0205838 | A1 | 8/2009 | Springett | |
| 2010/0038088 | A1 | 2/2010 | Springett et al. | |
| 2010/0243926 | A1 | 9/2010 | Weir | |
| 2010/0319906 | A1 | 12/2010 | Van Winkle | |
| 2012/0012340 | A1* | 1/2012 | Ensley et al. | 166/84.1 |

FOREIGN PATENT DOCUMENTS

| | | |
|---|---|---|
| GB | 1352258 | 9/1971 |
| GB | 1352260 | 9/1971 |
| GB | 2154265 | 3/1985 |
| WO | 2006014895 A2 | 2/2006 |

OTHER PUBLICATIONS

National Oilwell Varco. LWS Shaffer Ram Blowout Preventer [online], [retrieved on Apr. 29, 2010]. Retrieved from the Internet: <URL: http://www.nov.com/Drilling/Drilling_Pressure_Control/Blowout_Preventers/Ram_BOPs/LWS_Shaffer_Ram_Blowout_Preventer.aspx>.

National Oilwell Varco. NXT-Ram Blowout Preventer [online], [retrieved on Apr. 29, 2010]. Retrieved from the Internet: <URL: http://www.nov.com/Drilling/Drilling_Pressure_Control/Blowout_Preventers/Ram_BOPs/NXT-RAM_Blowout_Preventer.aspx>.

National Oilwell Varco. Ram Blowout Preventers [online], [retrieved on Apr. 29, 2010]. Retrieved from the Internet: <URL: http://www.nov.com/Drilling/Drilling_Pressure_Control/Blowout_Preventers/Ram_BOPs.aspx>.

National Oilwell Varco. Shaffer-SLX Ram Blowout Preventer [online], [retrieved on Apr. 29, 2010]. Retrieved from the Internet: <URL: http://www.nov.com/Drilling/Drilling_Pressure_Control/Blowout_Preventers/Ram_BOPs/Shaffer-SLX_Ram_Blowout_Preventer.aspx>.

National Oilwell Varco. Shaffer® 7"—5,000 psi LXT™ Ram BOP [online], [retrieved on Apr. 29, 2010]. Retrieved from the Internet: <URL: https://apps.nov.com/GetDocument/getDocument.aspx?doc=VauwU3oEmlRR5tXu4pHU9ZMorUn8t2fOkk/epJTd2wnzTwxUs9rJPGQhaetY9s5p0pUJ7Mjkr4e0TprFOSNmF9cRCTKggbZab8rkFiiVJxrGzB5CkviJajOOYKt8UeNI>.

National Oilwell Varco. Shaffer® 9"—3,000 psi LXT™ Ram BOP [online], [retrieved on Apr. 29, 2010]. Retrieved from the Internet: <URL: https://apps.nov.com/GetDocument/getDocument.aspx?doc=4mY2KOczvSp7xgbC/yAUNOlj8Xip0PFoCBfMqXeGZv8yoA+gy0YSN67XJhL9yJC7Jxv0KFBqycdmv+celNv8DKr9O1KrswSLTodwdeUHOjfSYNNAb8w4/Q3y6GJsnuyAdWmpT+6mzpjzD1T5hCdNCxLvXPFLH2z0Jp41vjuaVZw=>.

National Oilwell Varco. Shaffer® 11"—5,000 psi LXT Ram BOP [online], [retrieved on Apr. 29, 2010]. Retrieved from the Internet: <URL: https://apps.nov.com/GetDocument/getDocument.aspx?doc=4mY2KOczvSp7xgbC/yAUNHH4NngVNvgjSTgsbDKUG2SvCR7H5ZESdyAEqrxcgW/o6rqufYWXU6DWKF7jlGbLunTH4s52FHRihfqSujUiMirakeTXNCByEVNU0olPTHu8FOg3BT3zRZDOEdgl76cV9g==>.

National Oilwell Varco. Shaffer 13 5/8"—10,000 PSI LXT RAM BOP [online], [retrieved on Apr. 29, 2010]. Retrieved from the Internet: <URL: https://apps.nov.com/GetDocument/getDocument.aspx?doc=4mY2KOczvSp7xgbC/yAUNEwbgkvE1aylKwH+U89zJRfdujD68A7tvPw4eyAA3lz4dH2ZExbPe0QnqqPl5q3SS33ll6fKz+jwj9AVe2+jHPmG+9ahyvcejLFqDBkZfKmtrkaeiTCdGx+7e1+EE3ukehmBileYewHbwgkhaYTbBOk=>.

Varco's NXT® Next Generation BOP Systems reduce the cost of drilling (6 pages) (2011).

The Cameron Variable Bore Ram, Cameron Oil Tools (9 pages) (1978).

Ram-Type Blowout Preventers Rams, NL Shaffer, pp. 32-33 (Jan. 1979).

UltraLock II Automatic Locking System, Shaffer® A Varco Company (2 pages) (2002).

* cited by examiner

METHOD AND SYSTEM FOR SEALING A WELLBORE

CROSS REFERENCE TO RELATED APPLICATION

Applicant has also filed U.S. Non-Provisional application Ser. No. 12/838,701 entitled SYSTEM AND METHOD FOR SEALING A WELLBORE contemporaneously herewith.

BACKGROUND OF THE INVENTION

1. Field of the Invention

The present invention relates generally to techniques for performing wellsite operations. More specifically, the present invention relates to techniques, such as blowout preventers (BOPs) and/or ram blocks, for sealing wellbores.

2. Background of the Related Art

Oilfield operations are typically performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Tubing or pipes are typically positioned in the wellbore to enable the passage of subsurface fluids to the surface.

Leakage of subsurface fluids may pose a significant environmental threat if released from the wellbore. Equipment, such as blow out preventers (BOPs), are often positioned about the wellbore to form a seal about pipes therein to prevent leakage of fluid as it is brought to the surface. In some cases, the BOPs employ rams and/or ram blocks that seal the wellbore. Some examples of ram BOPs and/or ram blocks are provided in U.S. Pat. Nos. 4,647,002, 6,173,770, 5,025,708, 7,051,989, 5,575,452, 6,374,925, 2008/0265188, 5,735,502, 5,897,094, 7,234,530 and 2009/0056132.

Despite the development of techniques involving ram BOPs and/or ram blocks, there remains a need to provide advanced techniques for preventing leakage of subsurface fluids from wellbores. It may be desirable to provide techniques that provide more effective sealing and/or failure resistance. It may be further desirable to provide techniques that provide positive locking of seals. Preferably, such techniques involve one or more of the following, among others: adaptability to wellsite equipment (e.g., various pipe diameters), enhanced sealing, performance under deflection and/or wellsite equipment failures, distribution and/or absorption of loads, enhanced manufacturing capabilities (e.g., wider tolerances), balanced pressures, and increased capacity (e.g., load, pressure, etc.) The present invention is directed to fulfilling these needs in the art.

SUMMARY OF THE INVENTION

In at least one aspect, the present invention relates to a seal assembly for sealing a wellbore. The wellbore has a pipe therein for the passage of fluid therethrough and a blowout preventer (BOP) positionable about the pipe. The seal assembly has a plurality of blocks positionable within the BOP, each of the blocks having an opening extending into a cavity therein; at least one actuator for selectively moving the blocks to a contact position surrounding the pipe of the wellbore; and a plurality of pipe seals carried by the blocks for creating a seal about the pipe of the wellbore. The pipe seals being positionable in the cavities of the blocks and flowable through the opening thereof whereby at least a portion of a pressure applied to the pipe seals is released from the blocks.

In another aspect, the present invention relates to a system for sealing a wellbore. The wellbore has a pipe therein for the passage of fluid therethrough. The system has a BOP positionable about the pipe, and at least one seal assembly positionable about the BOP. Each of the seal assemblies have a plurality of blocks positionable within the BOP, each of the plurality of blocks having an opening extending into a cavity therein; at least one actuator for selectively moving the plurality of blocks to a contact position surrounding the pipe of the wellbore; and a plurality of pipe seals carried by the blocks for creating a seal about the pipe of the wellbore. The pipe seals being positionable in the cavities of the blocks and flowable through the opening thereof whereby at least a portion of a pressure applied to the pipe seals is released from the blocks.

Finally, in at least one aspect, the present invention relates to a method for sealing a wellbore. The wellbore has a pipe therein for the passage of fluid therethrough. The method involves positioning a BOP about the pipe, the BOP having a seal assembly therein comprising a plurality of blocks, each of the blocks having an opening extending into a cavity therein and a pipe seal in each cavity; pressing the pipe seals into sealing engagement with the pipe by selectively moving the blocks therein to a contact position surrounding the pipe of the wellbore; and permitting at least a portion of the pipe seals to flow through the opening of the blocks such that at least a portion of a pressure applied to the pipe seals is released from the blocks.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The figures are not necessarily to scale, and certain features and certain views of the figures may be shown exaggerated in scale or in schematic in the interest of clarity and conciseness.

In FIGS. 3A-C, the seal assembly is a dynamic seal assembly depicted in a first, second and third position, respectively, the dynamic seal assembly comprising ram blocks with dynamic pipe seals therein.

In FIGS. 4A-C, the seal assembly is a dynamic seal assembly depicted in a first, second and third position, respectively, the dynamic seal assembly comprising ram blocks with dynamic pipe seals therein.

FIG. 6A is an inner end view of the one of the ram blocks of FIG. 5A. FIG. 6B is a cross-sectional view of the ram block of FIG. 6A taken along line 6-6, with one of the dynamic pipe seals therein.

FIGS. 8A-C are various schematic views of one of the segments of FIG. 7.

In FIGS. 9A-B, the seal assembly is a static seal assembly, with a BOP adapter, depicted in a first and second position, respectively, the static seal assembly comprising ram blocks with static pipe seals therein.

In FIGS. 10A-B, the seal assembly is a static seal assembly, with a BOP adapter, depicted in a first and second position, respectively, the static seal assembly comprising ram blocks with static pipe seals therein.

FIG. 12A is an inner end view of the one of the ram blocks of FIG. 11A. FIG. 12B is a cross-sectional view of the ram block of FIG. 12A taken along line 12-12.

In FIGS. 15A-C, the seal assembly is a static seal assembly depicted in a first, second and third position, respectively, the static seal assembly comprising ram blocks with static pipe seals therein.

In FIGS. 16A-C, the seal assembly is a static seal assembly depicted in a first, second and third position, respectively, the static seal assembly comprising ram blocks with static pipe seals therein.

FIG. 18A is an inner end view of the one of the ram blocks of FIG. 17A. FIG. 18B is a cross-sectional view of the ram block of FIG. 18A taken along line 18-18.

DETAILED DESCRIPTION OF THE INVENTION

The description that follows includes exemplary apparatuses, methods, techniques, and instruction sequences that embody techniques of the present inventive subject matter. However, it is understood that the described embodiments may be practiced without these specific details.

Figure 1:
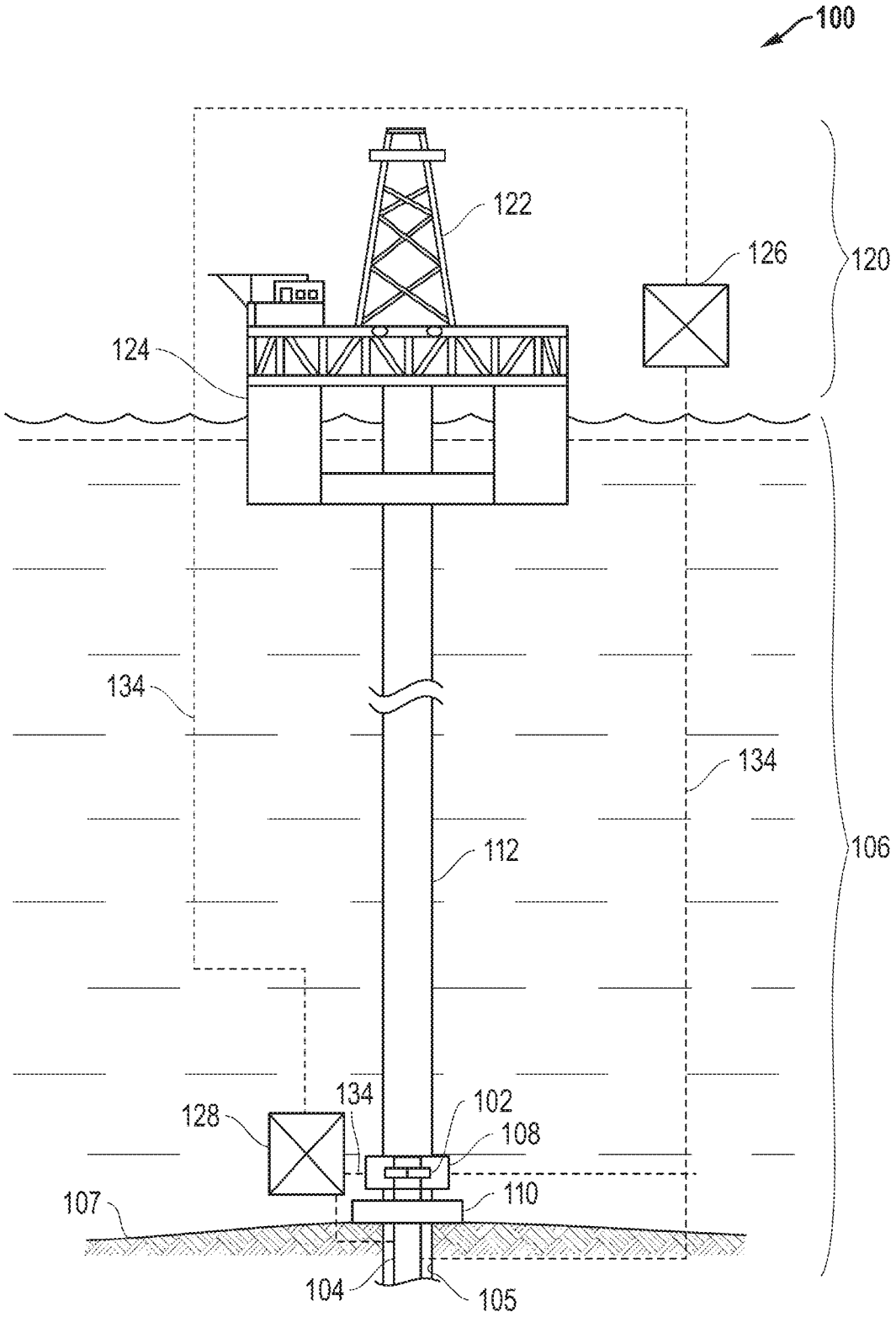
FIG. 1 shows a schematic view of an offshore wellsite having a BOP with a seal assembly therein according to the present invention.

FIG. 1 depicts an offshore wellsite 100 having a seal assembly 102 configured to seal a wellbore 105 extending into a seabed 107. As shown, the seal assembly 102 is positioned in a blowout preventer (BOP) 108 that is part of a subsea system 106 positioned on the seabed 107. The subsea system 106 may also comprise a pipe (or tubular) 104 extending from the wellbore 105, a wellhead 110 about the wellbore 105, a conduit 112 extending from the wellbore 105 and other subsea devices, such as a stripper and a conveyance delivery system (not shown). While the wellsite 100 is depicted as a subsea operation, it will be appreciated that the wellsite 100 may be land or water based, and the seal assembly 102 may be used in any wellsite environment.

A surface system 120 may be used to facilitate operations at the offshore wellsite 100. The surface system 120 may comprise a rig 122, a platform 124 (or vessel) and a surface controller 126. Further, there may be one or more subsea controllers 128. While the surface controller 126 is shown as part of the surface system 120 at a surface location and the subsea controller 128 is shown part of the subsea system 106 in a subsea location, it will be appreciated that one or more controllers may be located at various locations to control the surface and/or subsea systems.

To operate one or more seal assemblies 102 and/or other devices associated with the wellsite 100, the surface controller 126 and/or the subsea controller 128 may be placed in communication therewith. The surface controller 126, the subsea controller 128, and/or any devices at the wellsite 100 may communicate via one or more communication links 134. The communication links 134 may be any suitable communication means, such as hydraulic lines, pneumatic lines, wiring, fiber optics, telemetry, acoustics, wireless communication, any combination thereof, and the like. The seal assembly 102, BOP 108 and/or other devices at the wellsite 100 may be automatically, manually and/or selectively operated via the controllers 126 and/or 128.

Figure 2:
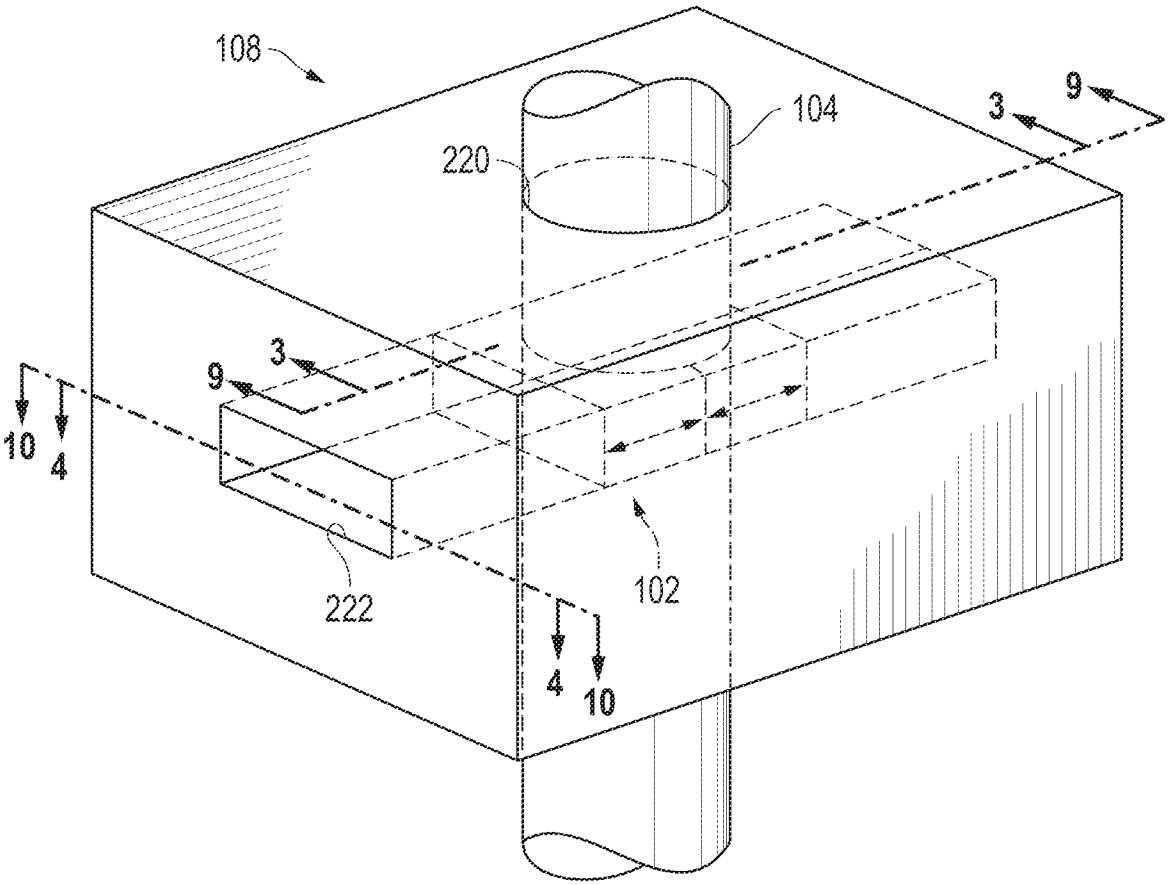
FIG. 2 shows a schematic view of the BOP of FIG. 1.
Figure 14:
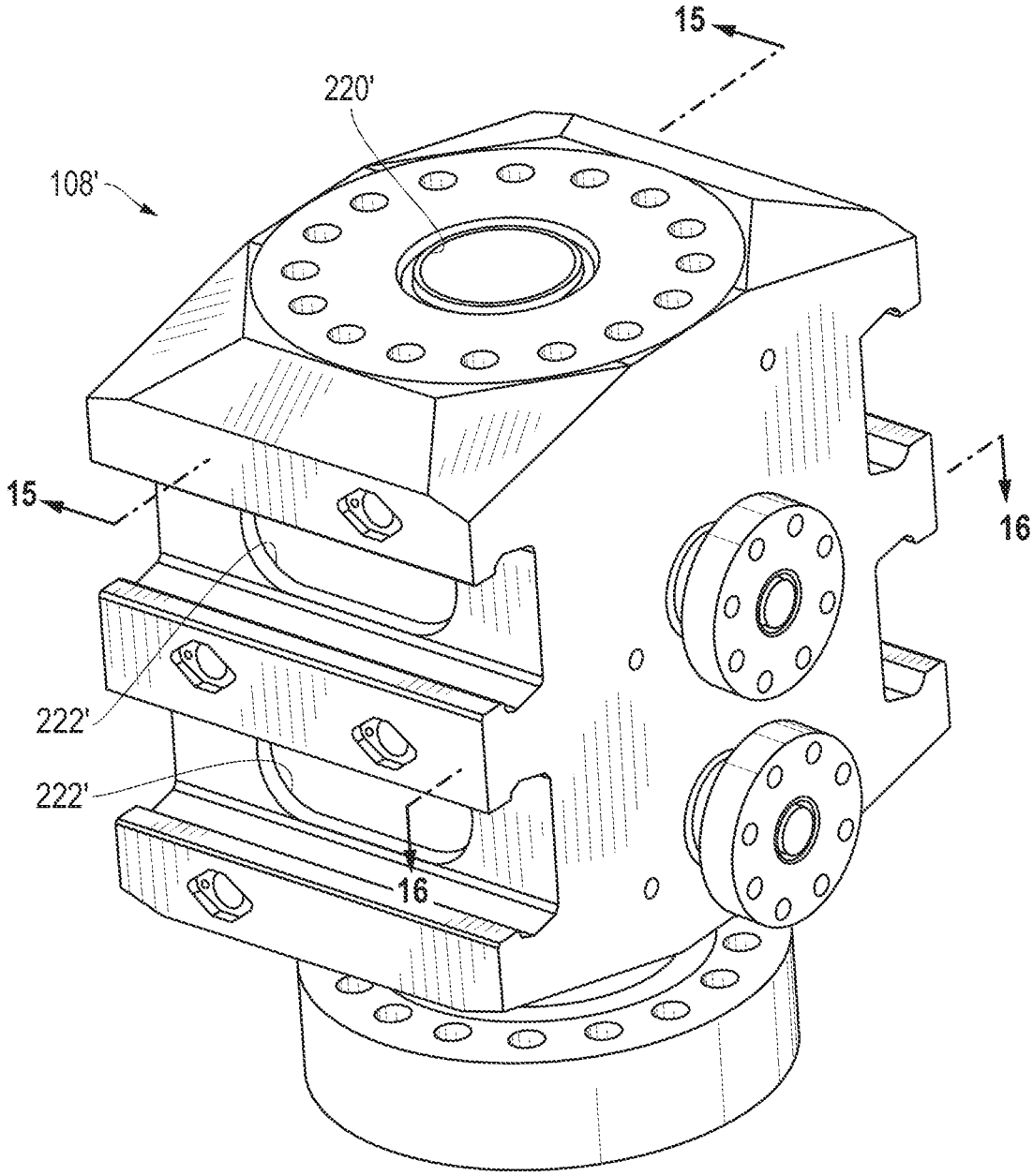
FIG. 14 shows a schematic view of an alternate BOP of FIG. 1.

FIG. 2 shows a detailed, schematic view of a BOP 108 that may be used as the BOP 108 of FIG. 1. The BOP 108 is depicted as a cuboid-shaped device having a hole 220 therethrough for receiving the pipe 104. The BOP 108 is also provided with a channel 222 therethrough for receiving the seal assembly 102. While the BOP 108 is depicted as having a specific configuration, it will be appreciated that the BOP 108 may have a variety of shapes, and be provided with other devices, such as sensors (not shown). An example of a BOP that may be used is described in U.S. Pat. No. 5,735,502, the entire contents of which is hereby incorporated by reference. Another BOP that may be used is depicted in FIG. 14 as will be described further herein.

Figure 3A:
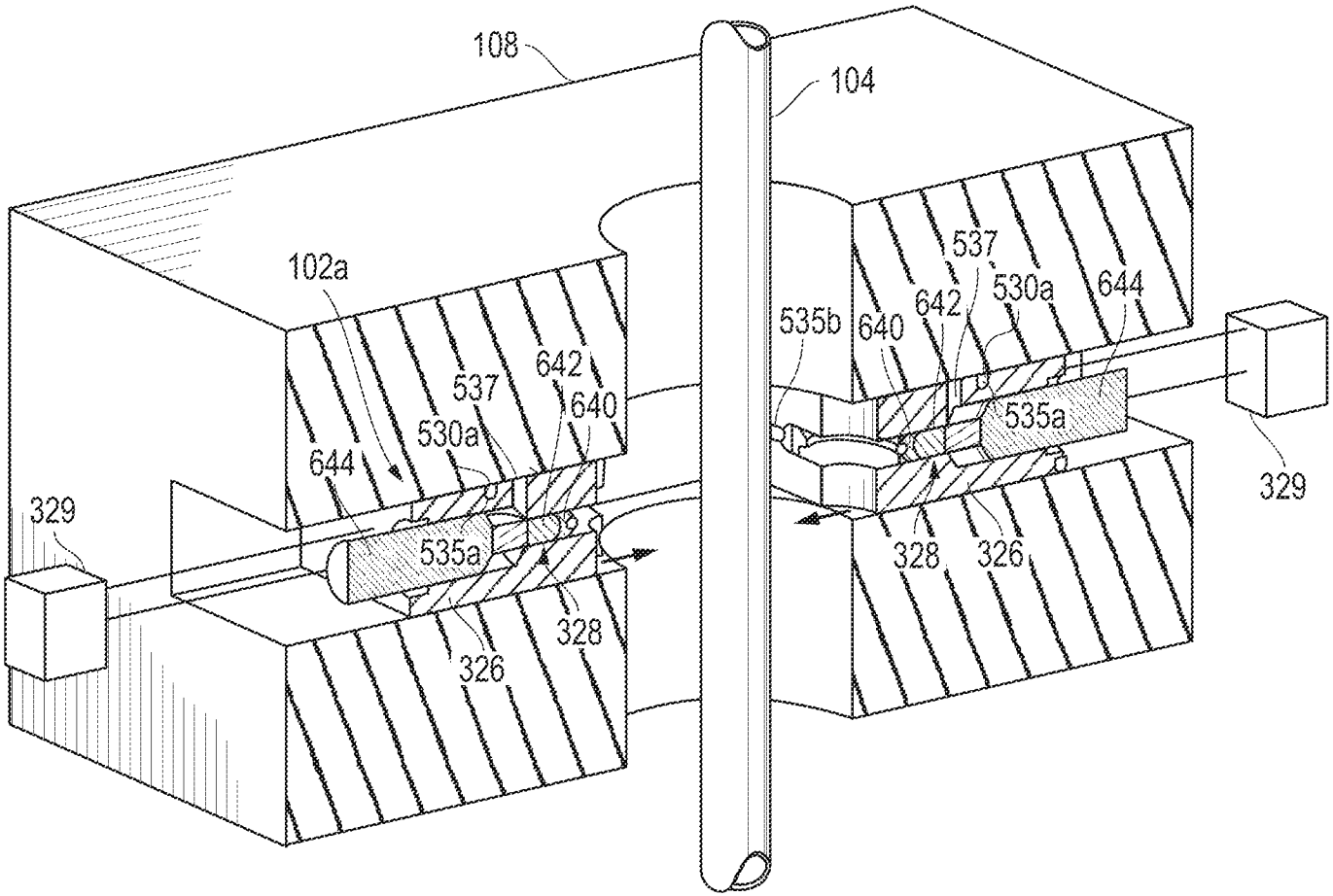
FIGS. 3A-C show longitudinal cross-sectional views of the BOP of FIG. 2 taken along line 3-3.
Figure 3B:
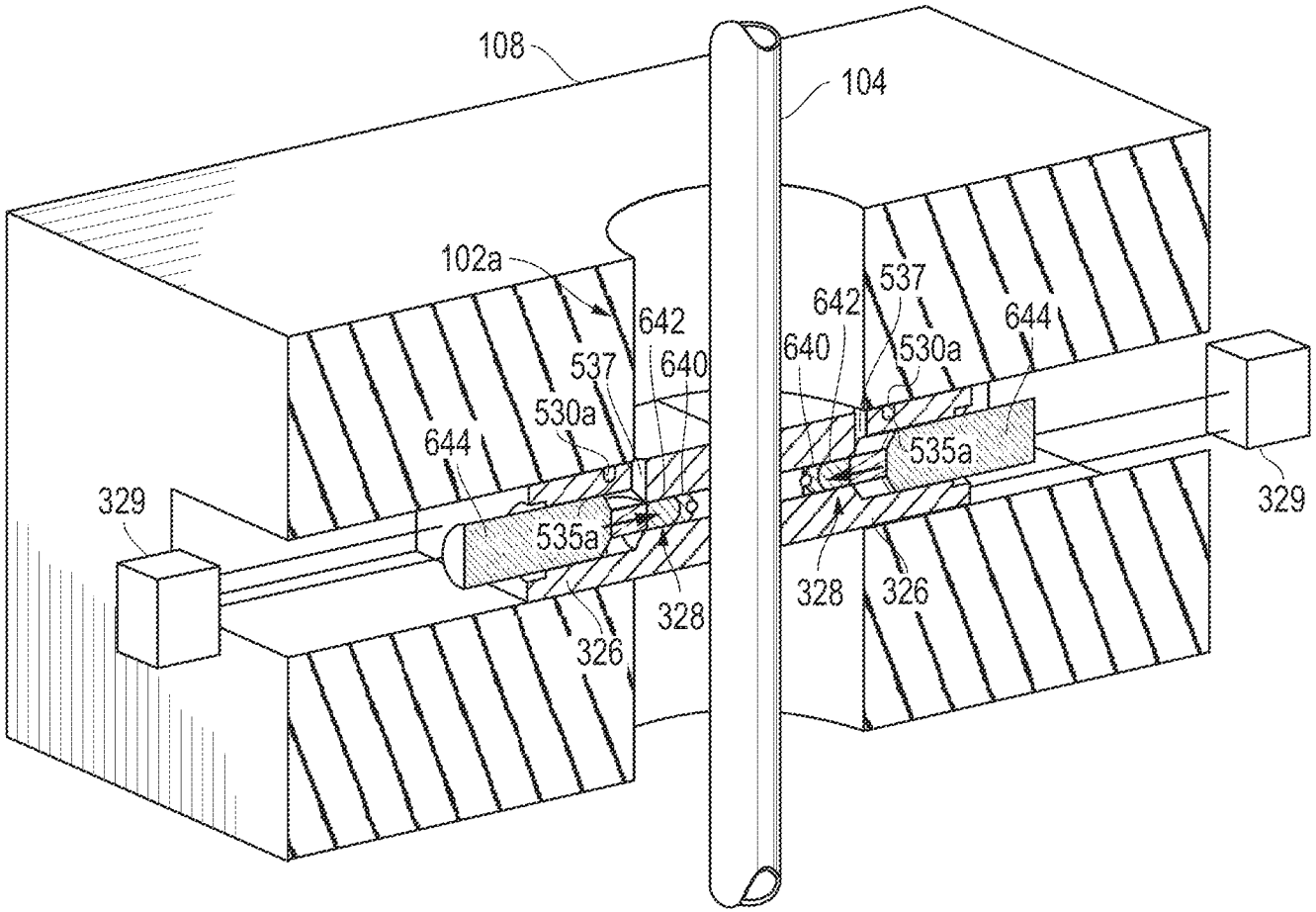
Figure 3C:
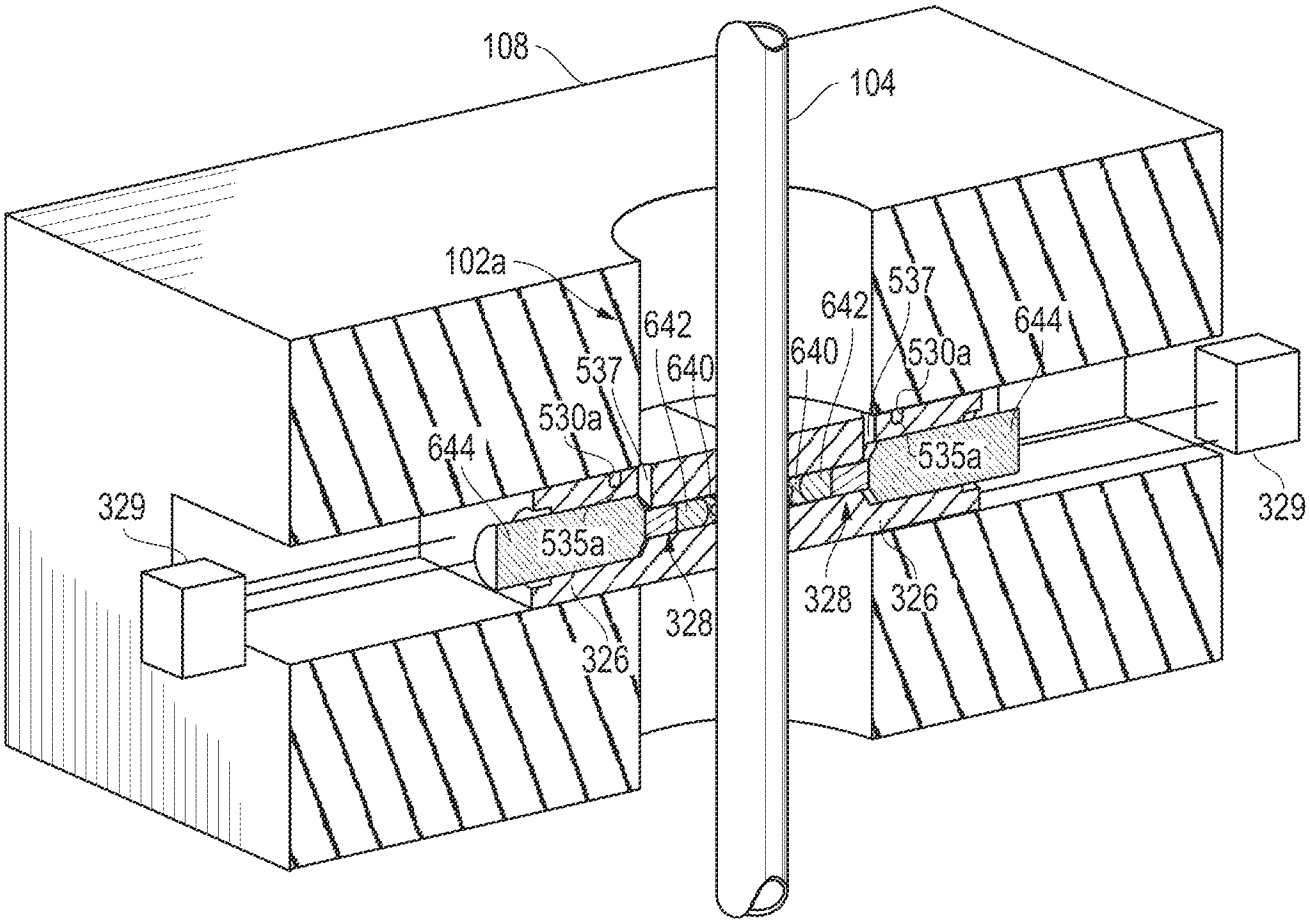
Figure 4A:
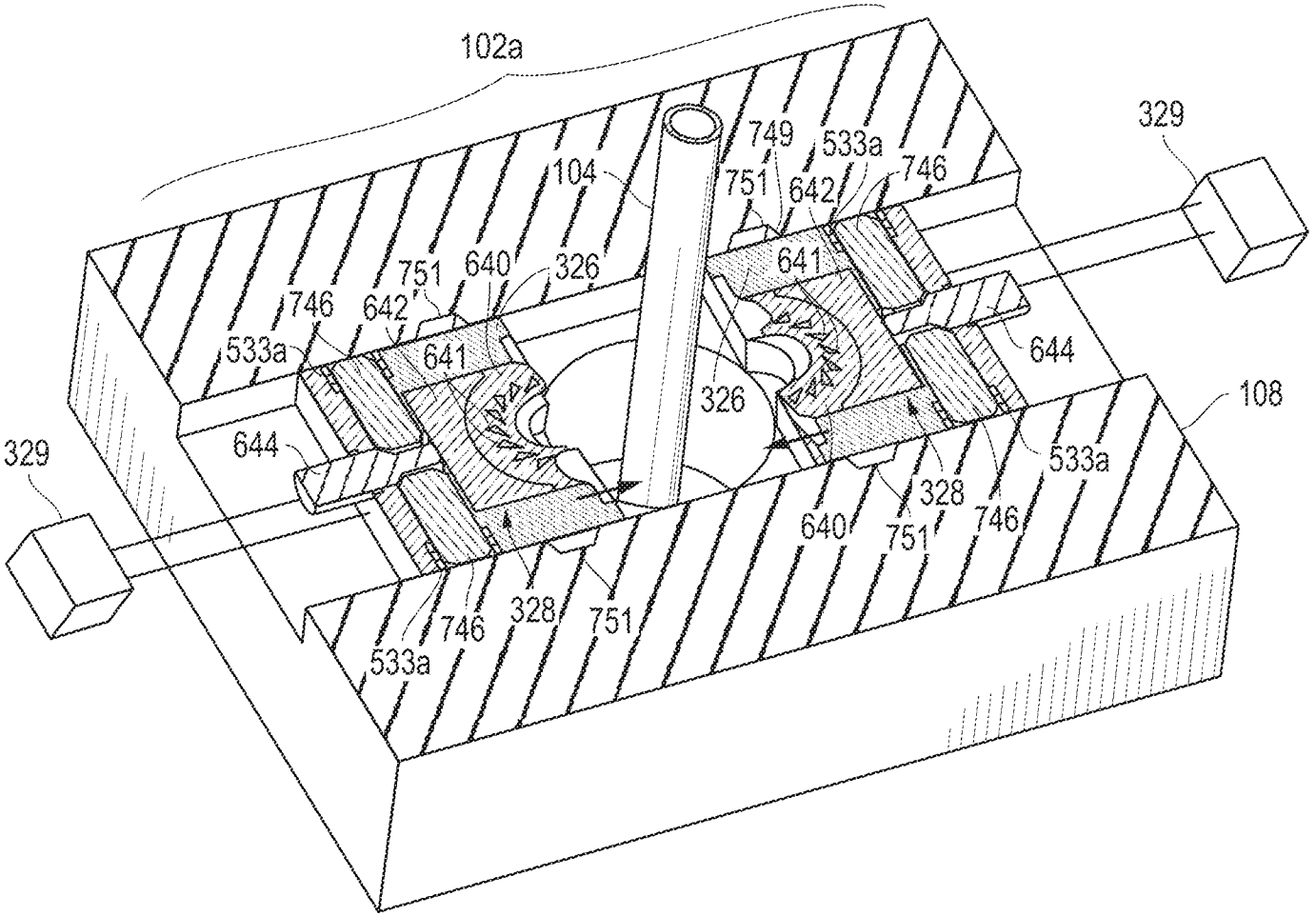
FIGS. 4A-C show horizontal cross-sectional views of the BOP of FIG. 2 taken along line 4-4.
Figure 4B:
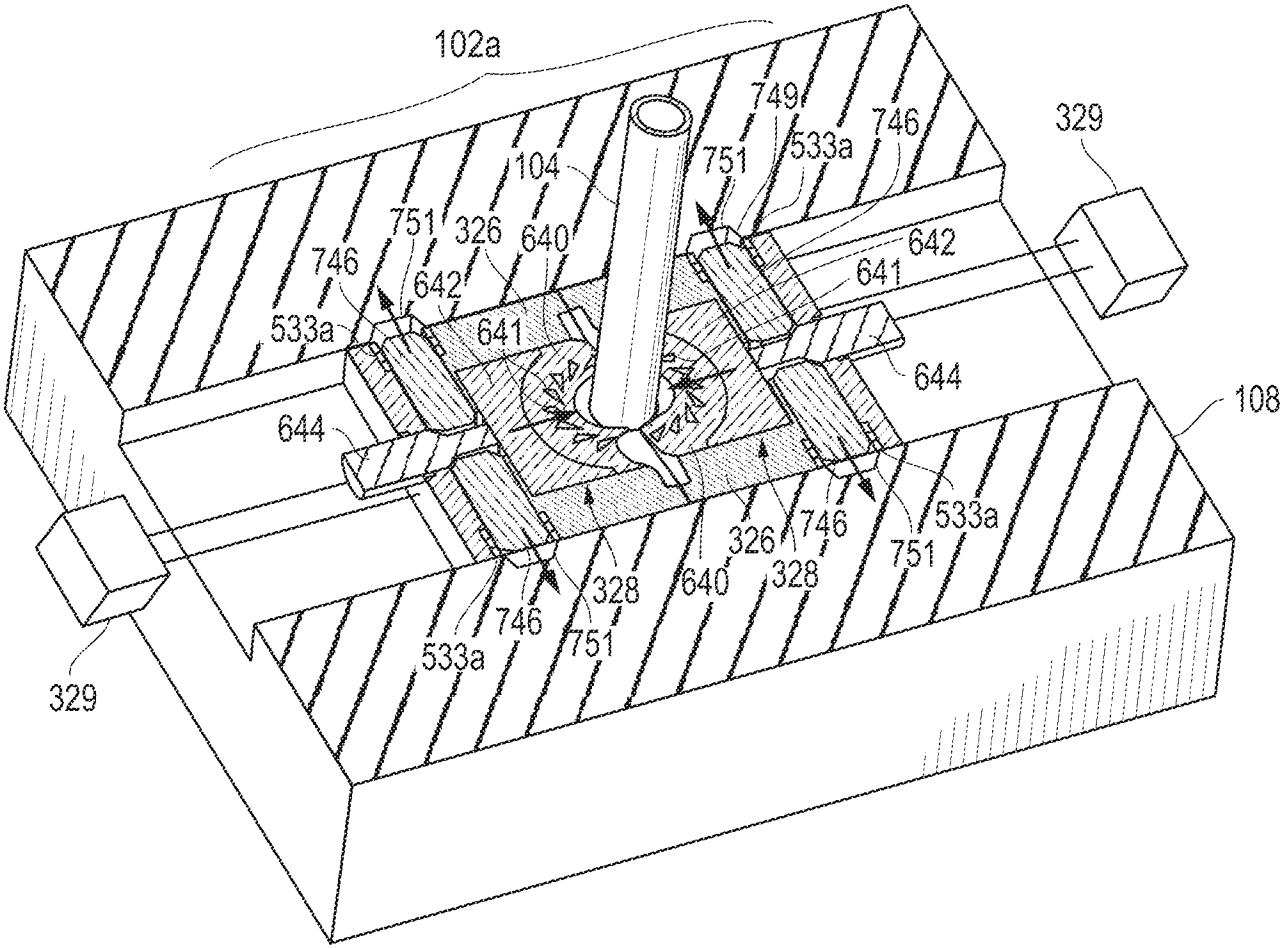
Figure 4C:
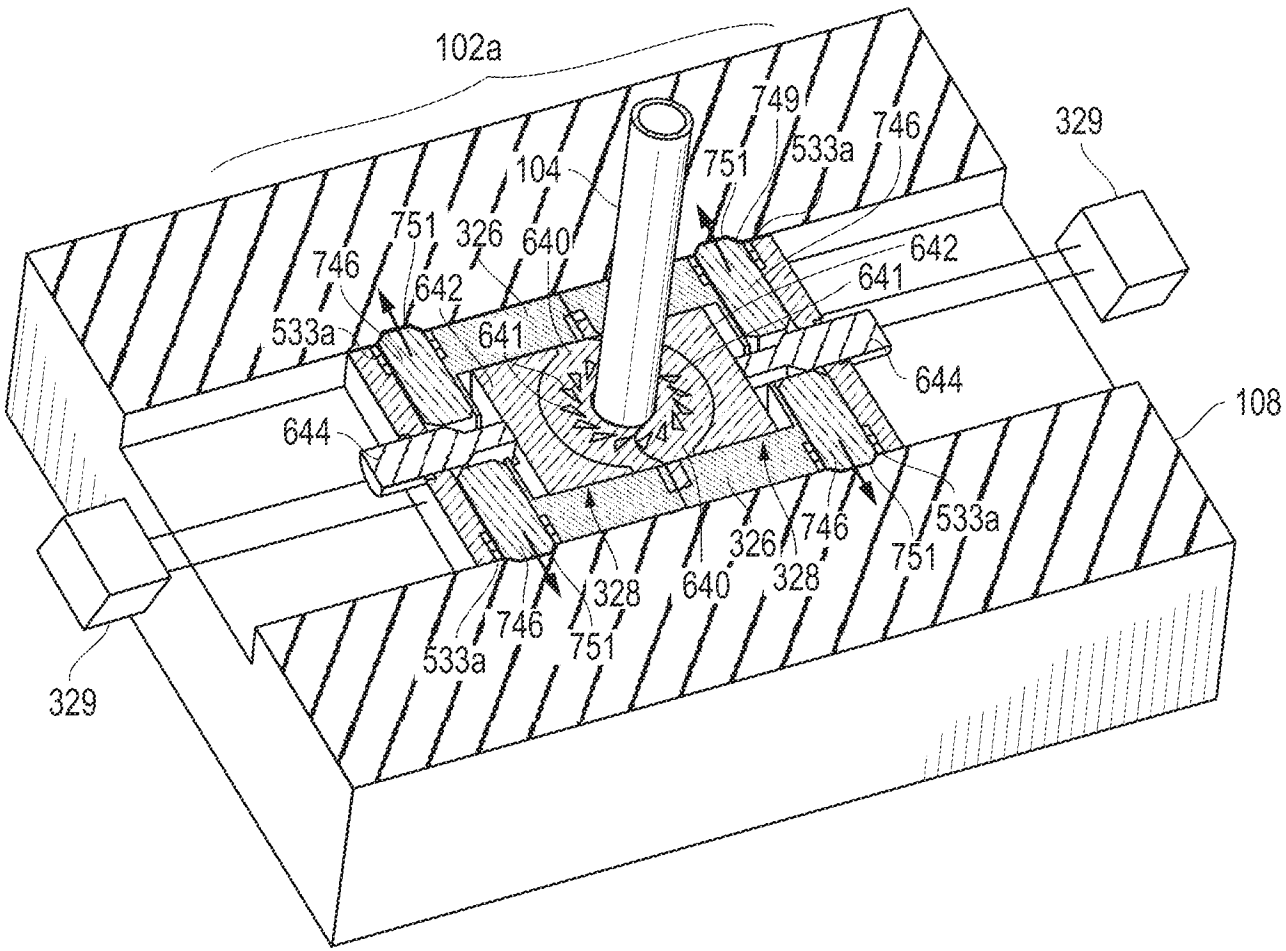

FIGS. 3A-C depict a dynamic seal assembly 102*a* usable as the seal assembly 102 of FIGS. 1 and 2. FIGS. 3A-3C are longitudinal, cross-sectional views of the BOP 108 and dynamic seal assembly 102*a* of FIG. 2 taken along line 3-3. FIGS. 4A-4C are horizontal, cross-sectional views of the BOP 108 and the dynamic seal assembly 102 of FIG. 2 taken along line 4-4. The seal assembly 102*a* comprises a pair of blocks (or ram blocks) 326, each block having a dynamic pipe seal 328 therein.

As shown in FIGS. 3A-3C and 4A-4C, the blocks 326 are slidably movable within the BOP 108 between a non-contact position as shown in FIGS. 3A and 4A, and a face-to-face contact position as shown in FIGS. 3B-3C and 4B-4C. As also shown in FIGS. 3A-3C and 4A-4C, the dynamic pipe seals 328 are slidably movable between a retracted position as shown in FIGS. 3A-3B and 4A-4B, and an extended position as shown in FIGS. 3C and 4C.

One or more actuators 329 may be provided for selectively activating one or more of the blocks 326 and/or pipe seals 328. The actuator(s) 329 may be positioned in and/or about the BOP 108 for selective actuation as desired. The actuators 329 may be controlled by the controller(s) 126 and/or 128 (FIG. 1). The actuator(s) 329 may be, for example, hydraulic cylinders that move the blocks 326 together (or closes the blocks) by pushing them from behind towards each other. Preferably, the actuator(s) 329 selectively move the blocks 326 to the contact position and the pipe seals 328 to the extended position for sealing engagement about the pipe 104.

During well control situations, the actuators 329 are typically actuated shut, which pushes the blocks 326 together to create a seal about pipe 104. When the situation is over, the actuators 329 may retract the blocks 326 into the BOP to ready for the next use. The actuator(s) 329 may be activated based on predefined criteria (e.g., timing, sensors, data, events, etc.) and/or as desired.

Figure 5C:
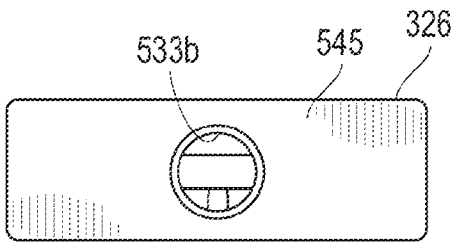
FIGS. 5A-5C show top, side and end views, respectively, of the ram blocks of FIG. 4C with the dynamic pipe seals removed.
Figure 5A:
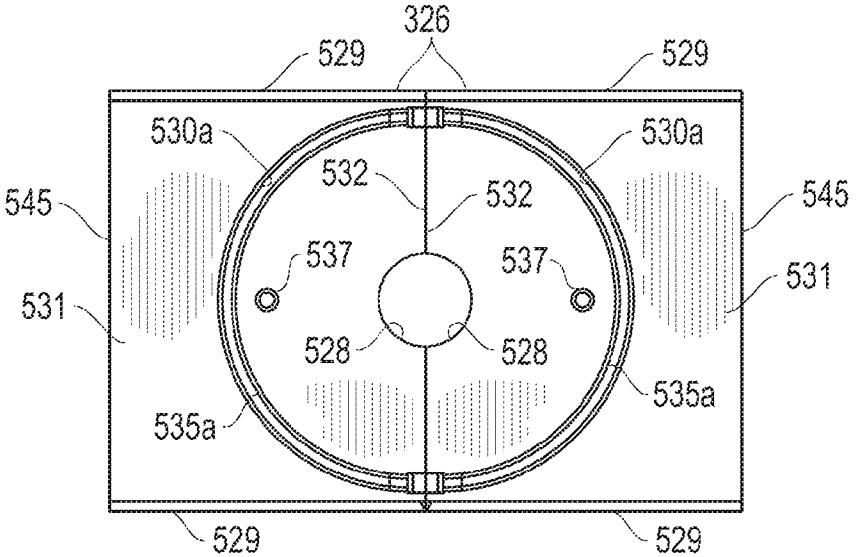
Figure 5B:
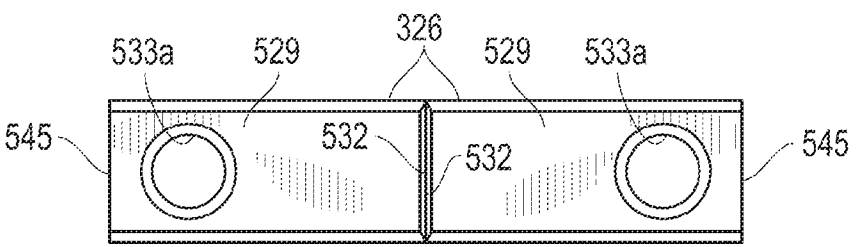

The blocks 326 are shown in greater detail in FIGS. 5A-5C (also shown in FIGS. 3A-3C and 4A-4C). FIGS. 5A-5C show top, plan and outer side views, respectively, of the blocks 326 in the face-to-face contact position. As shown in the top view of FIG. 5A, a pair of blocks 326 with a rectangular shape, an inlet 528 therethrough and a channel 530*a* therein is preferably provided. However, it will be appreciated that two or more blocks with a variety of shapes movable within the BOP 108 may be utilized.

In the contact position as shown in FIGS. 3B-3C, 4B-4C and 5A-5C, the inlets 528 of the blocks 326 form a hole configured to receive the pipe 104 (FIGS. 1 and 2). Also in the contact position as shown, the channels 530*a* of the blocks 326 form a continuous (and in this case circular) channel therebetween along a top surface 531 of the blocks 326. A surface seal 535*a* is positionable in the channel 530*a*. The surface seals 535*a* form a seal with the BOP 108 to prevent fluid from passing between the blocks 326 and the BOP 108 adjacent thereto (see, e.g., FIGS. 5A-5C). A vent or eye hole 537 is provided in each block 326 as will be described further herein.

The blocks 326 each have a contact surface 532 that is preferably flat for face-to-face engagement therebetween. The inlet 528 extends through each contact surface 532 on each block 326. This configuration provides positive touching of the blocks 326 along contact surfaces 532 of adjacent blocks 326. As shown, the contact surfaces 532 preferably meet and are pressed against each other. In this position, the blocks 326 surround and form a seal about the pipe 104 which is positioned in the inlets 528.

As shown in FIG. 5B, apertures 533*a* extend into side 529 of each of the blocks 326. As shown in FIG. 5C, apertures 533*b* extend into the outer end 545 of each block 326. The apertures 533*a* and 533*b* are configured to receive portions of the dynamic pipe seal 328 as will be described further herein.

Figure 6A:
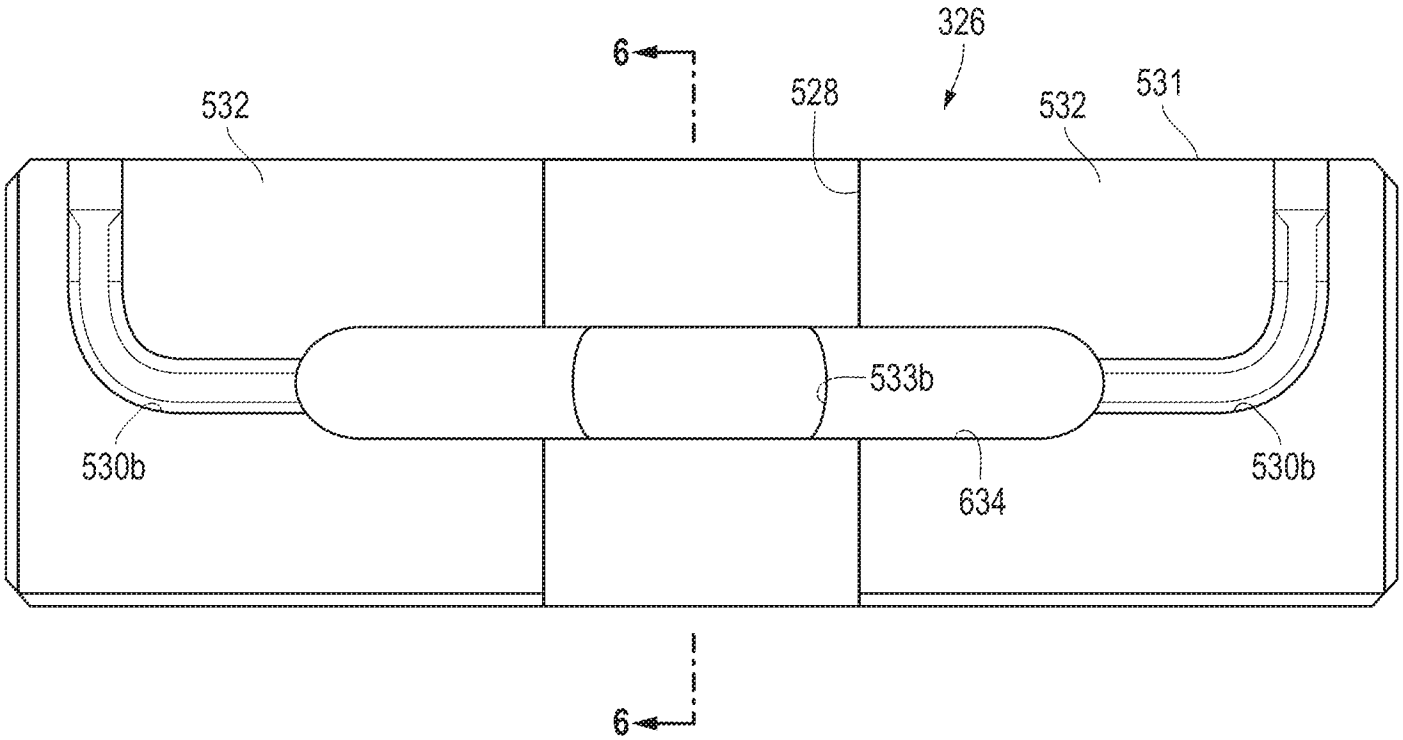
FIGS. 6A-6B are detailed views of one of the ram blocks of FIG. 5A.
Figure 6B:
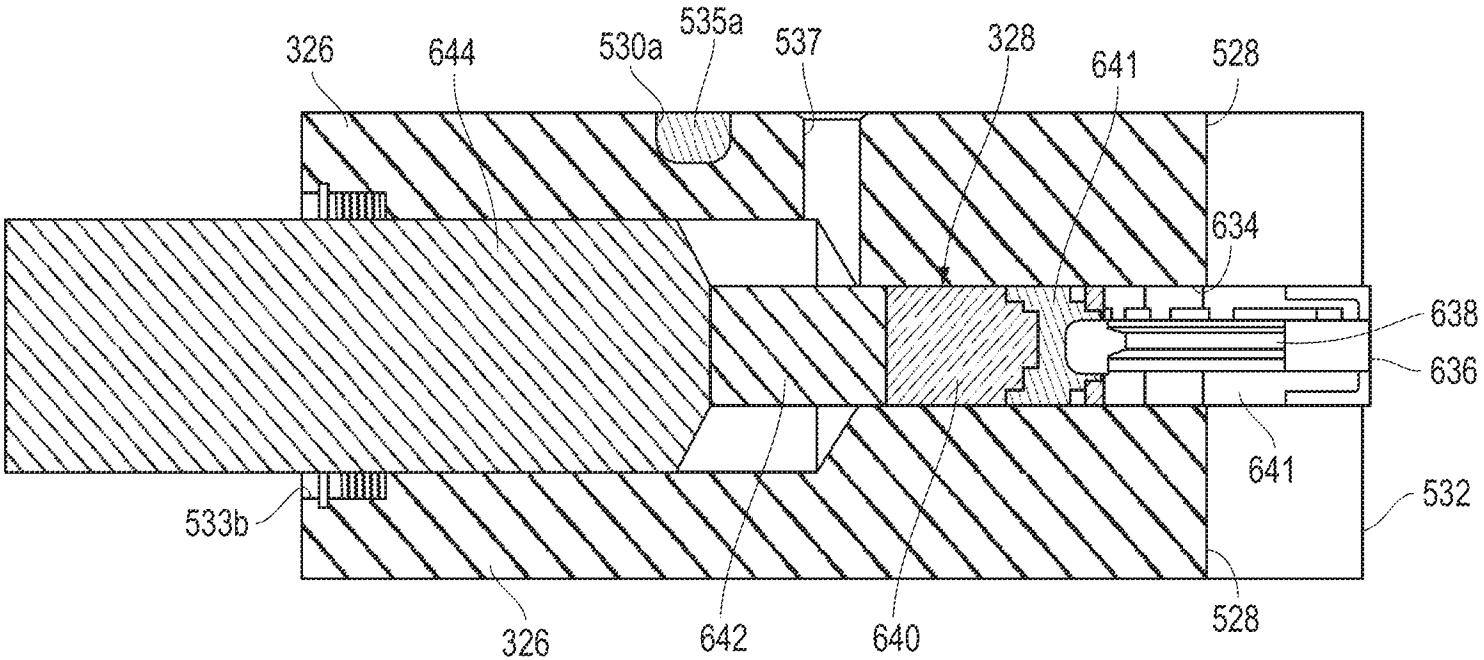

FIGS. 6A and 6B are detailed views of one of the blocks 326 (also shown in FIGS. 3A-3C and 4A-4C). FIG. 6A shows a plan view of the contact surface 532 of the block 326 with the pipe seal 328 removed. The contact surface 532 has the inlet 528 extending therethrough. Also, channel 530*b* extends from the top surface 531 and continues along the contact surface 532 on either side of the inlet 528. A cavity 634 extends through the contact surface 532 and into the block 326. The cavity 634 joins portions of channel 530*b* on either side of the inlet 528 to form a continuous channel along the contact surface 532. The cavity 634 also preferably extends through block 326 for communication with aperture 533*b*. Cavity 634 is configured to receive the dynamic pipe seal 328. The dynamic pipe seal 328 is slidably movable within the cavity 634. The dynamic pipe seal 328 is preferably positionable adjacent the static pipe seal 535 bin cavity 634 and the surface seal 535*b* in channel 530*b* to form a continuous seal along contact surface 532 and for sealing engagement therebetween to seal the BOP 108 (see, e.g., FIGS. 3B-C and 4B-C).

Figure 7:
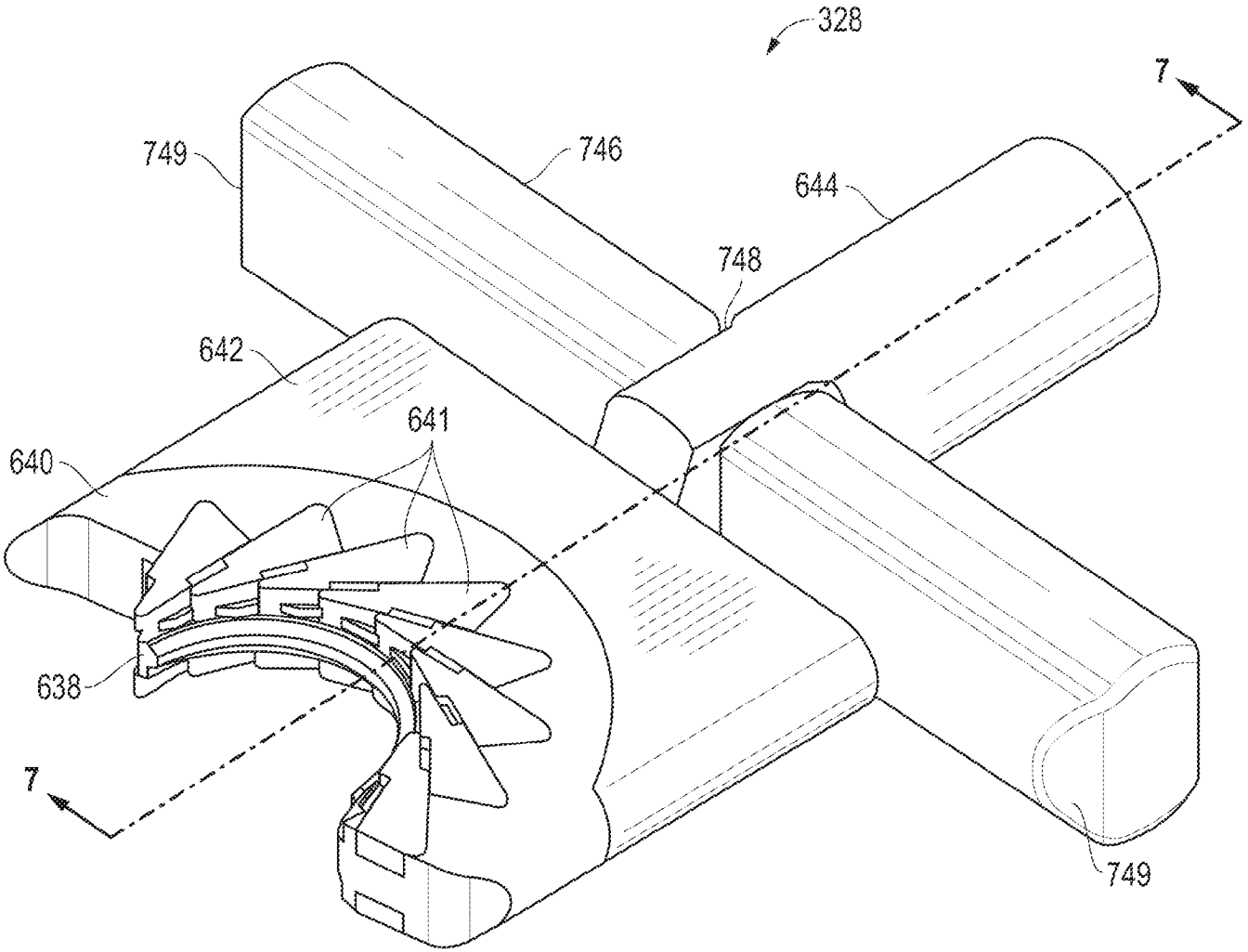
FIG. 7 shows a detailed, schematic view of one of the dynamic pipe seals of FIG. 4A, the dynamic pipe seal having segments.

FIG. 6B is a cross-sectional view of block 326 of FIG. 6A taken along line 6-6 with the dynamic pipe seal 328 of FIG. 7 taken along line 7-7 therein. This view shows the dynamic pipe seal 328 in the block 326 in the retracted position of FIGS. 3A-B and 4A-B. In the retracted position as shown, the pipe seal 328 is positionable such that a seal end 636 is positioned behind the contact surface 532 of block 326 to prevent damage thereto as the blocks 326 are moved to the contact position as shown in FIGS. 3B and 4B.

Vent hole 537 is shown as extending into aperture 533*b*. Cavity 634 is preferably in fluid communication with vent hole 537 for passage of fluid, such as air therebetween. The vent hole 537 may release pressure from the blocks 326 as the dynamic pipe seal 328 reciprocates within the block 326. Channel 530*a* with surface seal 535*a* therein is also depicted.

Referring to FIGS. 6B and 7, the dynamic pipe seal 328 is shown in greater detail (also shown in FIGS. 3A-3C and 4A-4C). The pipe seal 328 comprises a seal 640, a base 642 and a ram or drive shaft 644. The seal 640 is supported on base 642 and extends a distance therefrom. The drive shaft 644 is positioned adjacent base 642 on an opposite side from the seal 640. The drive shaft 644 may be connected to the base 642 for operation therewith. The seal 640, base 642 and drive shaft 644 are selectively movable within the block 326. Actuator 329 (FIG. 3A) may be used to move the dynamic pipe seal 328.

The seal 640 preferably has an arcuate shaped face seal or portion 638 adapted to receive a rounded (or near rounded) pipe 104 (FIGS. 1 and 2). The face seal 638 is preferably integral with the seal 640. The base 642 may be shaped to support the seal 640. As shown, the seal 640 may be provided with seal supports (or petals or segments) 641 for providing support to the face seal 638. The seal supports 641 may be positioned adjacent the face seal 638 in an interlocking formation for supporting the face seal 638 as it is pressed against pipe 104. While the seal supports 641 are depicted as discrete petals, it will be appreciated that the supports may be continuous, discrete, separate from and/or integral with the seal 640.

Figure 8A:
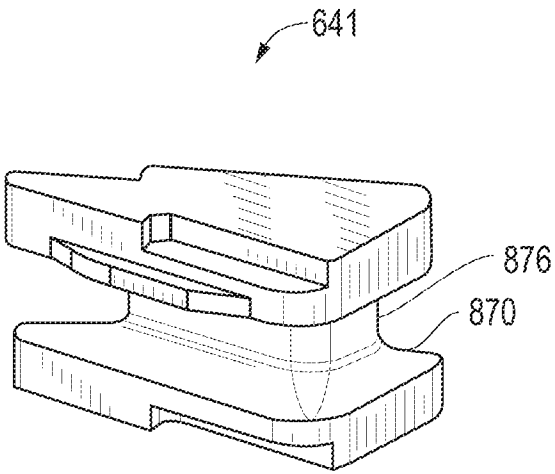

One of the seal supports 641 is shown in greater detail in FIGS. 8A-8C. As shown in these figures, each of the seal supports 641 has a body 876 with a channel 870 therethrough. The seal supports 641 are preferably provided with keys 872, and keyways 874 for receiving the keys 872. The keys 872, keyways 874 and other portions of the segments may be provided for interlocking positioning of the seal supports 641. A bonding agent or other materials may be placed about the seal supports 641 for adhesion of the seal supports 641 to the seal 640. While the seal supports 641 as shown have interlocking bodies of a certain shape, the seal supports 641 may be in the form of a unitary ring or other shape as desired to support the seal 640 to achieve the desired sealing engagement with pipe 104.

Preferably the seal 640 and the face seal 638 are made of an elastomeric or other material capable of sealing engagement with the pipe 104 (see, e.g., FIGS. 3C and 4C). The seal supports 641 may be made of elastomeric, plastic or other material, preferably more sturdy than the face seal 640 to provide support thereto. One or more gaskets or other sealing items may also be provided as desired for sealing within the BOP 108.

Referring back to FIGS. 6B and 7, the drive shaft 644 is positionable in aperture 533*b* of the blocks 326 and slidably movable therein. Preferably, the drive shaft 644 is snugly positionable within the aperture 533*b* such that the pipe seal 328 is maintained in balance therein during actuation. Base 642 is also preferably snugly fit within cavity 634 to provide further support and balance thereto.

As shown in FIGS. 7 and 4A-4C, locking arms (or dogs) 746 are preferably provided for operative interaction with the drive shaft 644. An actuator, such as actuator 329, may be used to activate the drive shaft 644 and/or the locking arms 746. The locking arms 746 are slidably positionable in apertures 533*a* in the blocks 326. The drive shaft 644 has recesses 748 on opposite sides thereof for receiving the locking arms 746.

Preferably the locking arms 746 are capable of securing the drive shaft 644 in a desired position and/or selectively preventing the drive shaft 644 from extension/retraction. The BOP 108 may be provided with pockets 751 for receiving the locking arms 746. The locking arms are movable between a locked position in the pockets 751 as shown in FIG. 4C, and an unlocked position a distance therefrom as shown in FIGS. 4A and 4B. The locking arms 746 and/or pockets 751 may be configured with angled surfaces 749 to facilitate movement of the locking arms 746 relative to the pockets 751.

The locking arms 746 are preferably configured to move into the locked position when the blocks 326 are moved to the contact position and the pipe seals 328 are moved to the seal position as shown in FIG. 4C. In the unlocked position of FIG. 4A-4B, the locking arms 746 are retracted to a position adjacent drive shaft 644, and the dynamic seal 328 is permitted to slidably move within the cavity 634. With the blocks 326 (with the seal assembly 102*a* therein) advanced to the face-to-face contact position of FIG. 4B, the locking arms 746 are positioned adjacent the pockets 751. The locking arms 746 are then permitted to move to the locked position extending into the pockets 751 and the pipe seal 328 may be activated to move to the extended or sealed position adjacent pipe 104 as indicated by the arrows.

Once the locking arms 746 extend into the pockets 751 as shown in FIG. 4C, the blocks 326 are preferably maintained in the face-to-face contact position and prevented from retracting. The actuator 329 may be used to activate the blocks 326, pipe seal 328, locking arms 746 and/or other components of the seal assembly 102*a* to achieve the desired movement. The actuator 329 may also be used to continue to apply force, maintain a given level of force, or discontinue applying force as desired. Seals 535*b* of each block 326 are also preferably pressed together for sealing engagement therebetween. As force is applied to advance the pipe seal 328, the force may also be used to provide continued motion of the drive shaft 644 to urge the pipe seal 328 against the pipe 104.

The seal assembly 102*a* is preferably configured to prevent damage to the seal 640 and/or face seal 638. Preferably, the blocks 326 are activated to move from the retracted position of FIGS. 3A and 4A to the face-to-face contact position of FIGS. 3B and 4B with the pipe seal 328 in the retracted position as shown herein. Once the blocks 326 are moved to the contact position, and preferably locked in place with locking arms 746, the pipe seal 328 may be moved to the seal position of FIGS. 3C and 4C.

In order to prevent damage to seals 638, 639, 640 or other seal components, it is further preferable that the pipe seal 328 remain recessed within cavity 634 until the blocks 326 are moved to the contact position. As shown in FIGS. 3A and 4A, the pipe seal 328 remains in a retracted position in the cavity 634 until the blocks 326 move to the contact position of FIGS. 3B and 4B. Once the blocks are moved to the contact position, the pipe seals 328 may be extended for sealing engagement with pipe 104. This configuration and/or activation preferably prevents the pipe seal 328 from being extended between the blocks 326 and potentially causing damage to the blocks 326 and/or pipe seals 328 as the blocks 326 move to the contact position.

Figure 9A:
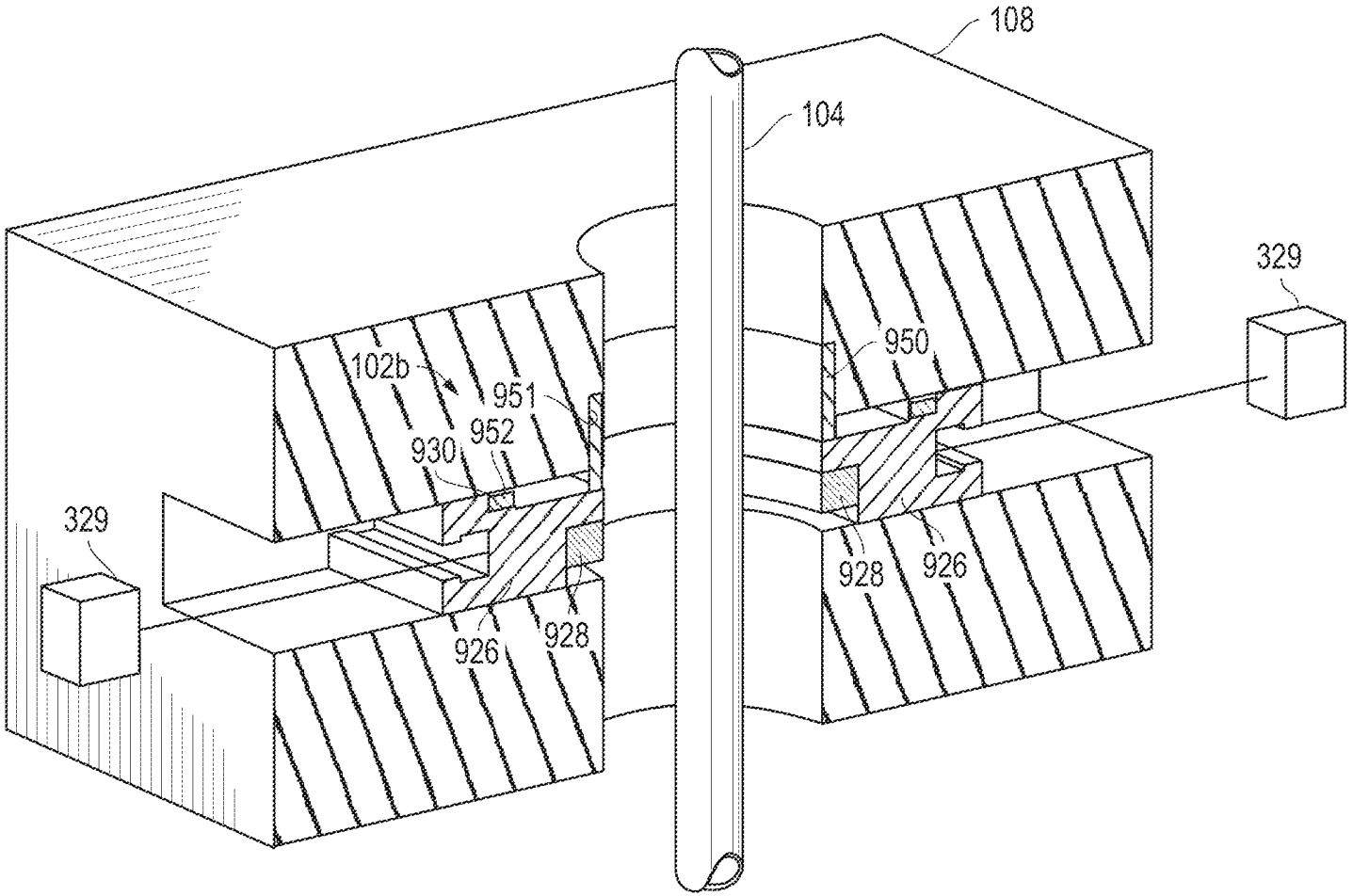
FIGS. 9A and 9B show longitudinal cross-sectional views of the BOP of FIG. 2 taken along line 9-9.

FIGS. 9A-13 depict a static seal assembly 102*b* usable as the seal assembly 102 of FIGS. 1 and 2. FIGS. 9A and 9B are longitudinal, cross-sectional views of the BOP 108 and static seal assembly 102*b* of FIG. 2 taken along line 9-9. FIGS. 10A and 10B are horizontal, cross-sectional views of the BOP 108 and the static seal assembly 102*b* of FIG. 2 taken along line 10-10. FIG. 10A-C are detailed views of the static seal assembly 102*b* depicting the components thereof. The static seal assembly 102*b* comprises a BOP adapter 950 and a pair of blocks (or ram blocks) 926, each block having a static pipe seal 928 therein.

Figure 9B:
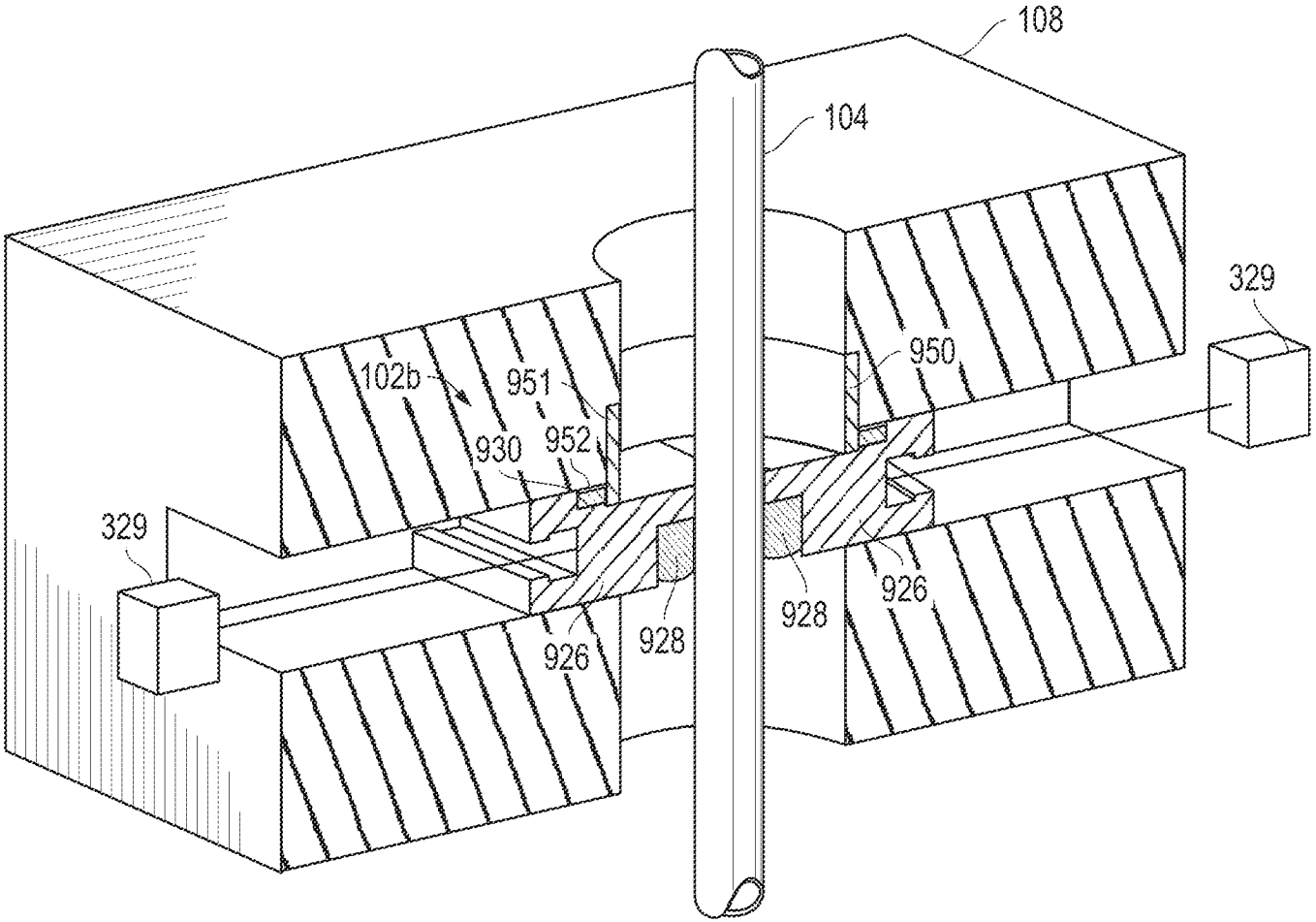
Figure 10A:
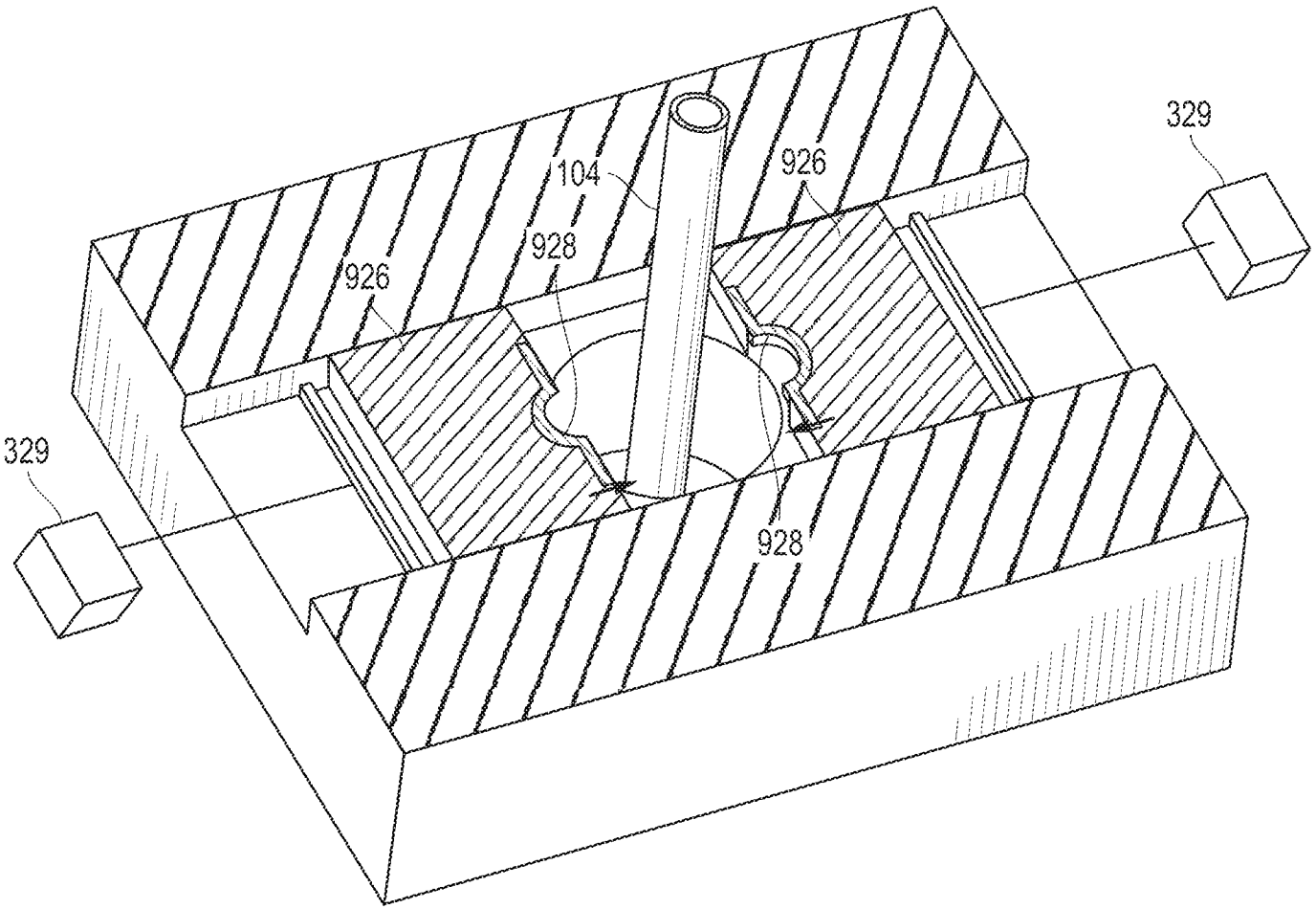
FIGS. 10A and 10B show horizontal cross-sectional views of the BOP of FIG. 2 taken along line 10-10.
Figure 10B:
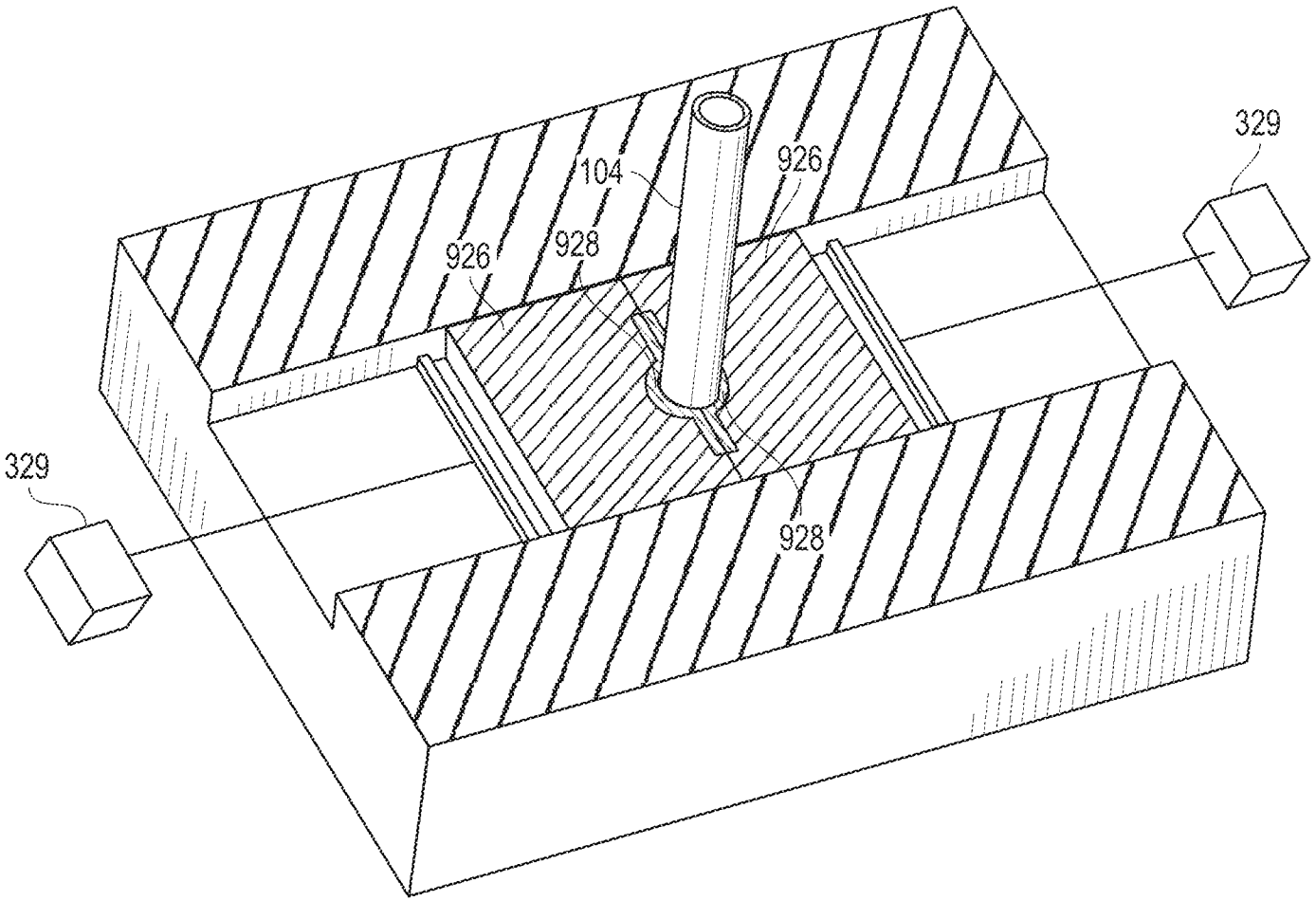

As shown in FIGS. 9A-9B and 10A-10B, the blocks 926 are slidably movable within the BOP 108 between a non-contact position as shown in FIGS. 9A and 10A, and a face-to-face contact position as shown in FIGS. 9B and 10B. The static pipe seal 928 is positioned in the blocks 926 and carried thereby. One or more actuators 329 may be provided for selectively activating the blocks 926 in the same manner as the blocks 326 and/or 1526 as described herein.

The BOP adapter 950 is preferably a tubular member positioned in the BOP 108. As shown, the BOP 108 may be modified to receive the BOP adapter 950, for example by machining a recess 951 therein adapted to receive the BOP adapter 950. The BOP adapter 950 is positioned in the BOP 108 and is engaged by the blocks 926 during operation. The blocks 926 are adapted to receive the BOP adapter 950 and preferably engage the BOP adapter 950 when in the face-to-face contact position. A surface seal 952 may be provided in each block 926 for sealing with the BOP adapter 950.

Figure 11A:
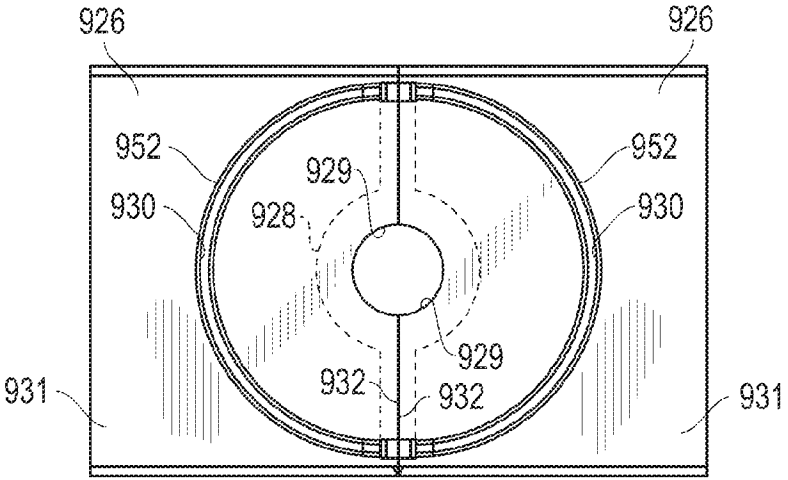
FIGS. 11A-11C show top, side and end views, respectively, of the ram blocks of FIG. 10B.
Figure 11B:
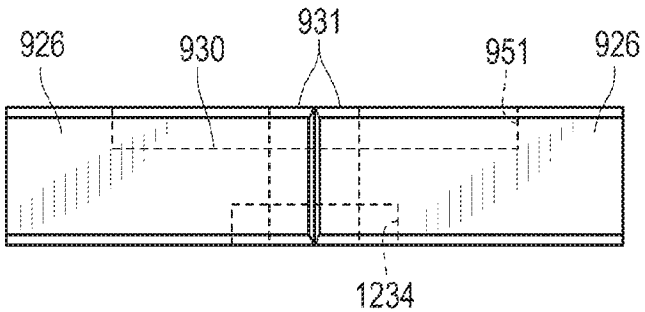
Figure 11C:
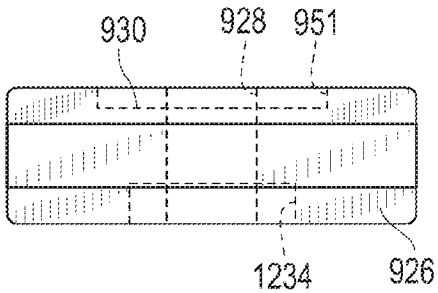

The blocks 926 are shown in greater detail in FIGS. 11A-11C (also shown in FIGS. 9A-9B and 10A-10B). FIGS. 11A-11C show top, plan and outer side views, respectively, of the blocks 926 in the face-to-face contact position. As shown in the top view of FIG. 11A, the pair of blocks 926 preferably have a rectangular shape, with an inlet 929 and a depression 930 therein. However, it will be appreciated that two or more blocks 926 may be provided with a variety of shapes movable within the BOP 108.

The blocks 926 each have a contact surface 932 that is preferably flat for face-to-face engagement therebetween. The inlet 929 extends through each contact surface 932 on each block 926. This configuration provides positive touching of the blocks 926 along contact surfaces 932 of adjacent blocks 926. As shown in FIGS. 11A and 11B, the contact surfaces 932 preferably meet and are pressed against each other. In this position, the blocks 926 surround the pipe 104 which is positioned in the inlets 929 (see FIGS. 1 and 2).

In the contact position as shown, the inlets 929 of the blocks 926 form a hole configured to receive the pipe 104 (see FIGS. 1 and 2). Also in the contact position as shown, the depressions 930 of the blocks 926 form a continuous (and in this case circular) depression therebetween along a top surface 931 of the blocks 926. The surface seal 952 is positionable in the depression 930. The depressions 930 are preferably configured for receiving the surface seal 952, and for receiving the BOP adapter 950 when in the contact position. The surface seal 952 as shown is a semi-oval member positionable in the depression 930 for sealing engagement with the BOP adapter 950 and the BOP 108. As shown in FIGS. 9A and 9B, the surface seal 952 is positionable in the depression 930 to form a seal with the BOP 108 and the BOP adapter 950 to prevent fluid from passing between the blocks 926 and the BOP 108 adjacent thereto.

Figure 12A:
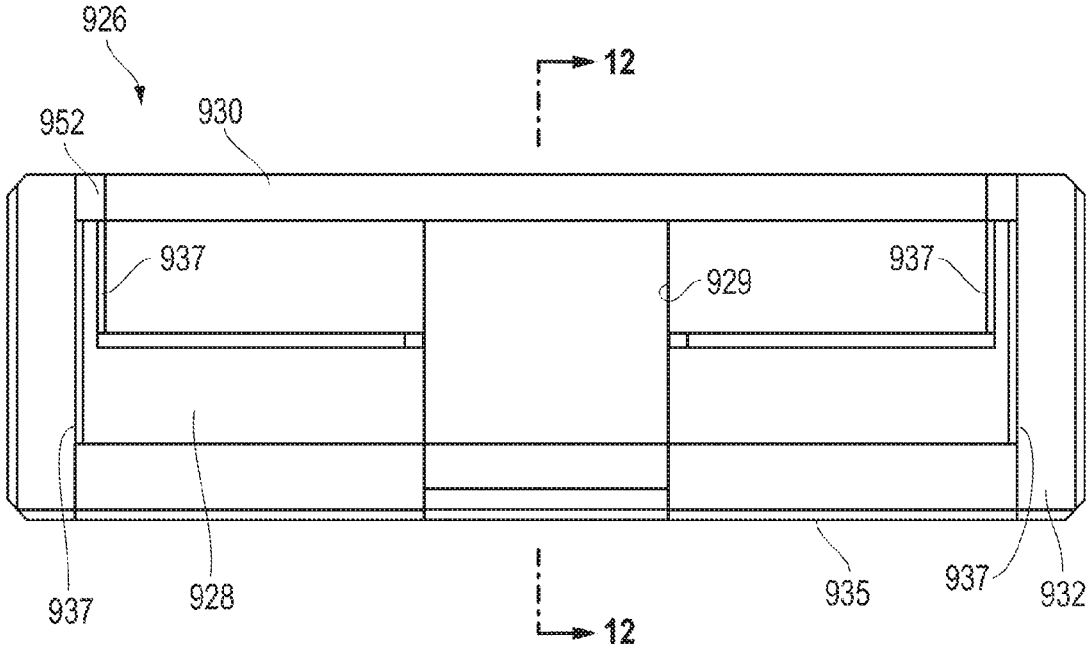
FIGS. 12A-12B are detailed views of one of the ram blocks of FIG. 11A.
Figure 12B:
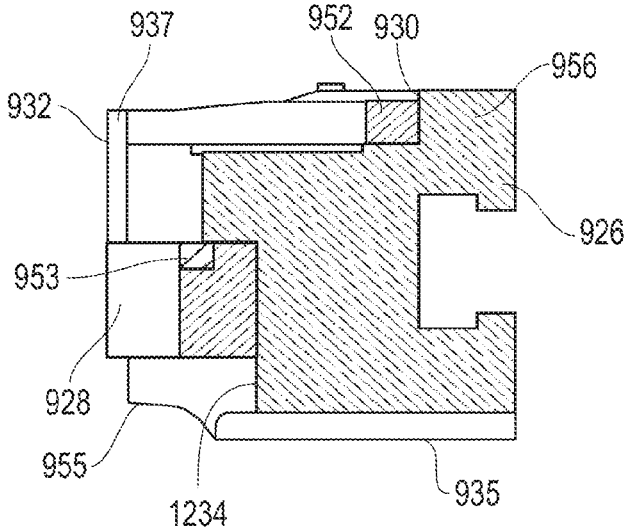

FIGS. 12A and 12B are detailed views of one of the blocks 926 (also shown in FIGS. 9A-9C, 10A-10C and 11A-11C). FIG. 12A shows a plan view of the contact surface 932 of the block 926 with the surface seal 952 and the pipe seal 928 therein. FIG. 12B is a cross-sectional view of block 926 of FIG. 12A taken along line 12-12. The contact surface 932 has the inlet 929 extending therethrough. A cavity 1234 extends through the contact surface 932 and into the block 926 about inlet 929. The cavity 1234 also extends through a bottom surface 935. Cavity 1234 is configured to receive the static pipe seal 928. The static pipe seal 928 is preferably positionable in the cavity 1234 for sealing engagement with the pipe 104 when the blocks 926 are in the contact position as will be described further herein.

The static pipe seal 928 is positioned in cavity 1234 for sealing engagement with pipe 104 (see, e.g., FIGS. 9B and 10B). As shown, the static pipe seal 928 is positioned in a top portion of cavity 1234 and does not fill the entire cavity 1234. While the static pipe seal 928 may be sized to fill cavity 1234, cavity 1234 is preferably defined (in this case semi-circularly) to receive pipe seal 928 with additional space to permit deformation of the pipe seal 928 within the cavity 1234. The cavity 1234 is preferably open through the bottom surface 935 to permit the static pipe seal 928 to flow therethrough when pipe 104 is pressed against the pipe seal 928.

As shown in FIGS. 12A and 12B, an anti-extrusion ring 953 is provided in static pipe seal 928. The anti-extrusion ring 953 preferably prevents the static pipe seal 928 from flowing into the inlet 929 adjacent contact surface 932. The static pipe seal 928 is permitted to flow from cavity 934 and out opening 955 therein as the blocks 926 are moved into the contact position of FIGS. 9B and 10B. An anti-extrusion plate 937 may also be provided to further prevent the seal from flowing between the blocks 926.

Figure 13:
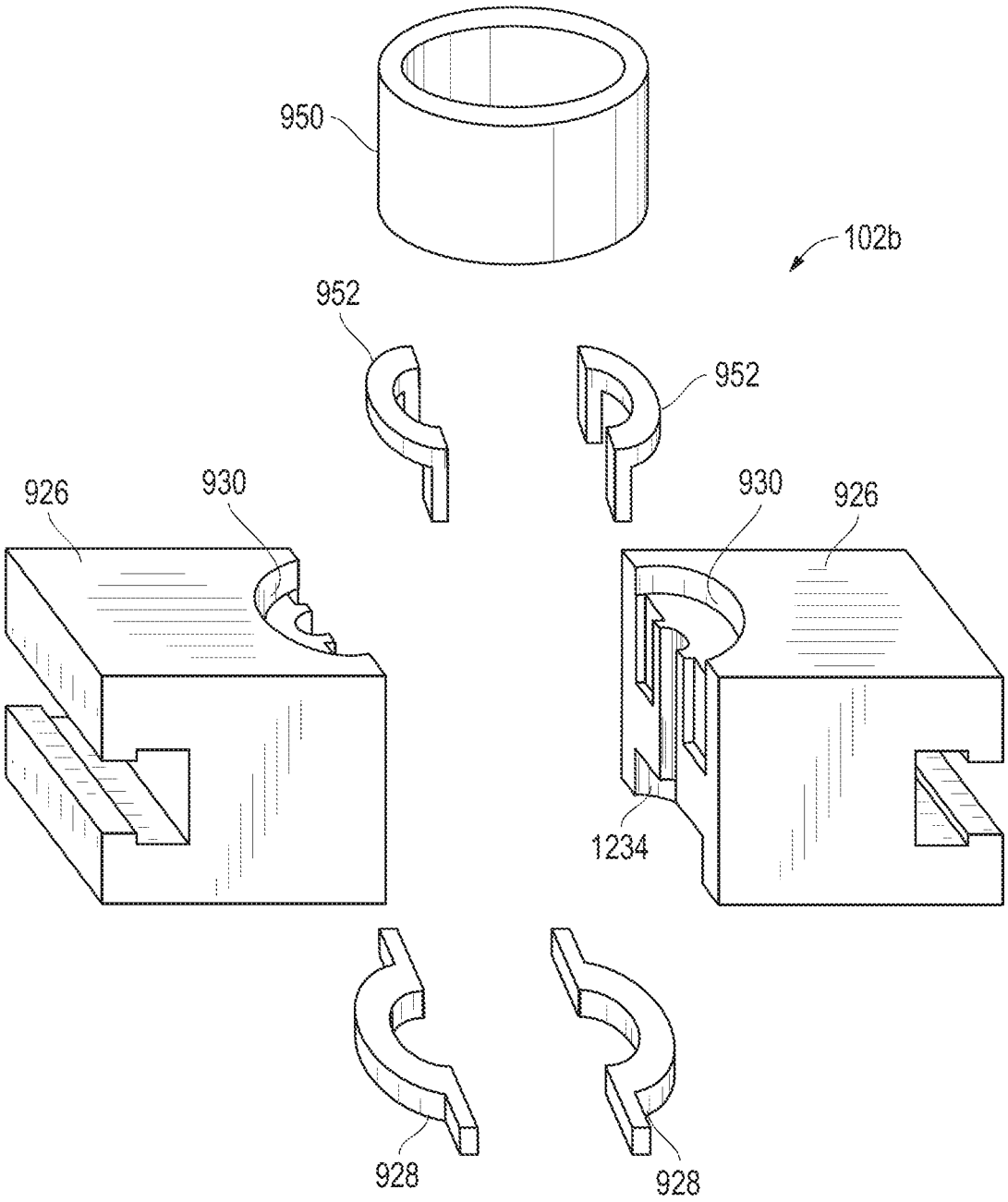
FIG. 13 shows an exploded view of one of the static seal assemblies of FIG. 9A.

Referring to FIGS. 12B and 13, the static seal assembly 102*b* is shown in greater detail (also shown in FIGS. 9A-9B and 10A-10B). FIG. 13 provides an exploded view of the seal assembly 102*b*. In this view, the surface seal 952, static pipe seals 928 and arcuate-shaped depression 930 and cavity 1234 are depicted. Also, the BOP adapter 950 is depicted as a tubular member. Preferably, the static pipe seal 928, the surface seal 952 and any gaskets used therewith are made of an elastomeric or other material capable of sealing engagement. Supports, such as seal supports 641 as used with the dynamic pipe seal 328 of FIGS. 3A-8C may be used with the static pipe seal 928 and/or the surface seal 952.

In operation, the blocks 926 (with the static pipe seal 928 therein) advance to the face-to-face contact position of FIGS. 9B and 10B, and the blocks 326 are pressed together. As the blocks 926 are advanced, the force applied to the blocks preferably provides continued motion to press the blocks 926 together and to urge the seals 928 against the pipe 104. Also, as the blocks 926 advance, surface seals 952 are also pressed against BOP adapter 950 for sealing engagement therewith. The actuator 329 may be used to activate the blocks 926 and/or other components of the seal assembly 102*b* to achieve the desired movement. The actuator 329 may also be used to continue to apply force, maintain a given level of force, or discontinue applying force as desired. Seals 928 and 952 of each block 926 are also preferably pressed together for sealing engagement therebetween.

The seal assembly 102*b* is preferably configured to prevent damage to the surface seal 952 and/or static pipe seal 928. Preferably, the blocks 926 are activated to move from the retracted position of FIGS. 9A and 10A to the face-to-face contact position of FIGS. 9B and 9B with the static pipe seal 928 in the retracted position as shown herein. In order to prevent damage to surface seals 952 and static pipe seal 928, it is further preferable that such seals remain recessed within depression 930 and cavity 1234, respectively, until the blocks 926 are moved to the contact position. Once moved, the seals 952,928 may flow in cavity 1234 (and out the bottom of block 926 if needed) and about the blocks 926 and/or pipe 104 as they are compressed.

As shown in FIGS. 9A and 9B (and also seen in FIGS. 12A and 12B), the pipe seal 928 are positioned in the cavity 1234 as the blocks 926 move to the contact position of FIGS. 9B and 10B. This unconfined configuration and/or activation preferably permits the seals 928 to flow out of the blocks 926 as pressure is applied thereto. As the blocks are pressed together, the static pipe seal 928 is preferably prevented from flowing between the blocks 926, but is permitted to flow out cavity 1234. This unconfined configuration also allows the blocks 926 to receive a boost force applied thereto during activation, and also preferably reduces the pressure on the seals 928 and the strain on the blocks 926.

As shown, the static pipe seal 928 is positioned in a top portion of cavity 1234 and does not fill the entire cavity. While the static pipe seal 928 may be sized to fill cavity 1234, cavity 1234 is preferably defined to receive pipe seal 928 with additional space to permit deformation of the pipe seal 928 within the cavity 1234. The cavity 1234 is preferably open through a bottom surface 935 of blocks 926 to permit the static pipe seal 928 to flow therethrough when pipe 104 is pressed against the pipe seal 928.

The actuator 329 and wellbore pressure outside the blocks 926 apply a force to the blocks 926 as they are pressed together. In the face-to-face contact position of FIGS. 9B and 10B, the blocks 926 are permitted to press together to distribute force therebetween. To permit the face-to-face contact position, it is preferable that the pipe seals 928 are prevented from extending between the blocks 926. By allowing the pipe seals 928 to flow out the cavity 1234, forces applied to the pipe seal 928 are permitted to exit the blocks 926. Preferably, the pipe seals 928 are permitted to flow out of the blocks 926 to prevent forces applied to the blocks 926 from remaining in the blocks and potentially causing damage thereto.

Preferably, the pipe seal is configured to withstand ultra high pressure of about 30,000 psi (206.84 MPa) or more of wellbore pressure, as well as lower pressures. For the static seal assembly 102*b*, the rubber of the seals therein is preferably allowed to flow where it needs to, and is not fully confined. This configuration is provided to reduce the rubber pressure which reduces the stress in the block that contains the rubber. The rubber pressure may be around, for example, the pressure of the wellbore fluid.

FIG. 14 shows a detailed, schematic view of an alternate BOP 108' that may be used as the BOP 108 of FIG. 1. The BOP 108' is depicted as having a hole 220' therethrough for receiving the pipe 104. The BOP 108 is also provided with two channels 222' therethrough for receiving the seal assembly (or assemblies) 102. While the BOP 108' is depicted as having a specific configuration, it will be appreciated that the BOP 108 may have a variety of shapes, and be provided with other devices, such as sensors (not shown). An example of a BOP that may be used is depicted in U.S. Pat. No. 5,735,502, previously incorporated by reference herein. Also, the BOP of FIG. 2 may also be employed.

Figure 15A:
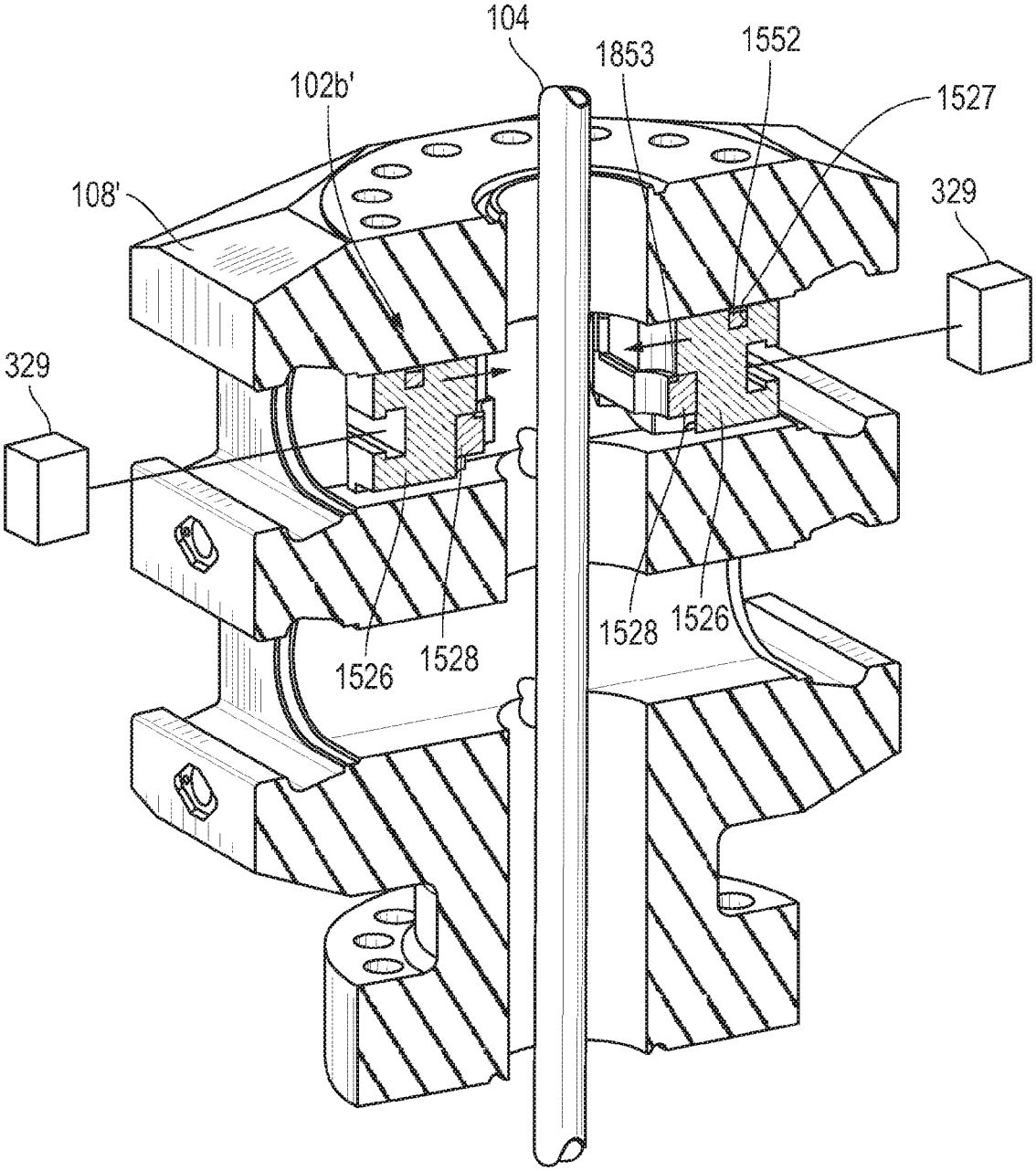
FIGS. 15A-15C show longitudinal cross-sectional views of the BOP of FIG. 14 taken along line 15-15.
Figure 15B:
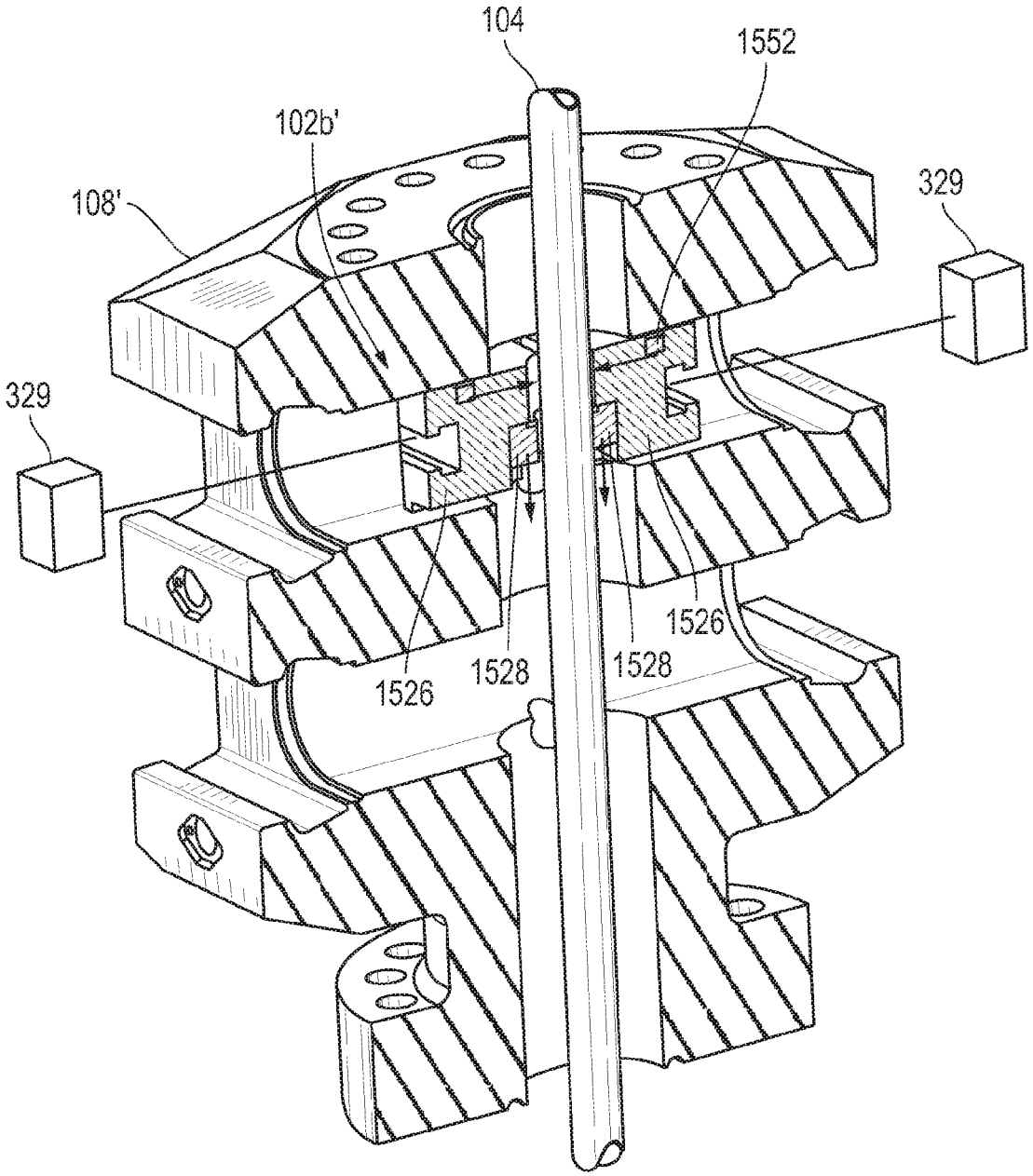

FIGS. 15A-17B depict a static seal assembly 102*b*' usable as the seal assembly 102 of FIGS. 1 and 2. FIGS. 15A-15C are longitudinal, cross-sectional views of the BOP 108' of FIG. 14 taken along line 15-15 with the static seal assembly 102*b*' therein. FIGS. 16A-16C are horizontal, cross-sectional views of the BOP 108' and the static seal assembly 102*b*' of FIG. 14 taken along line 16-16. FIGS. 18A-C are detailed views of the static seal assembly 102*b*' depicting the components thereof. The seal assembly 102*b*' comprises a pair of blocks (or ram blocks) 1526, each block having a static pipe seal 1528 therein.

Figure 15C:
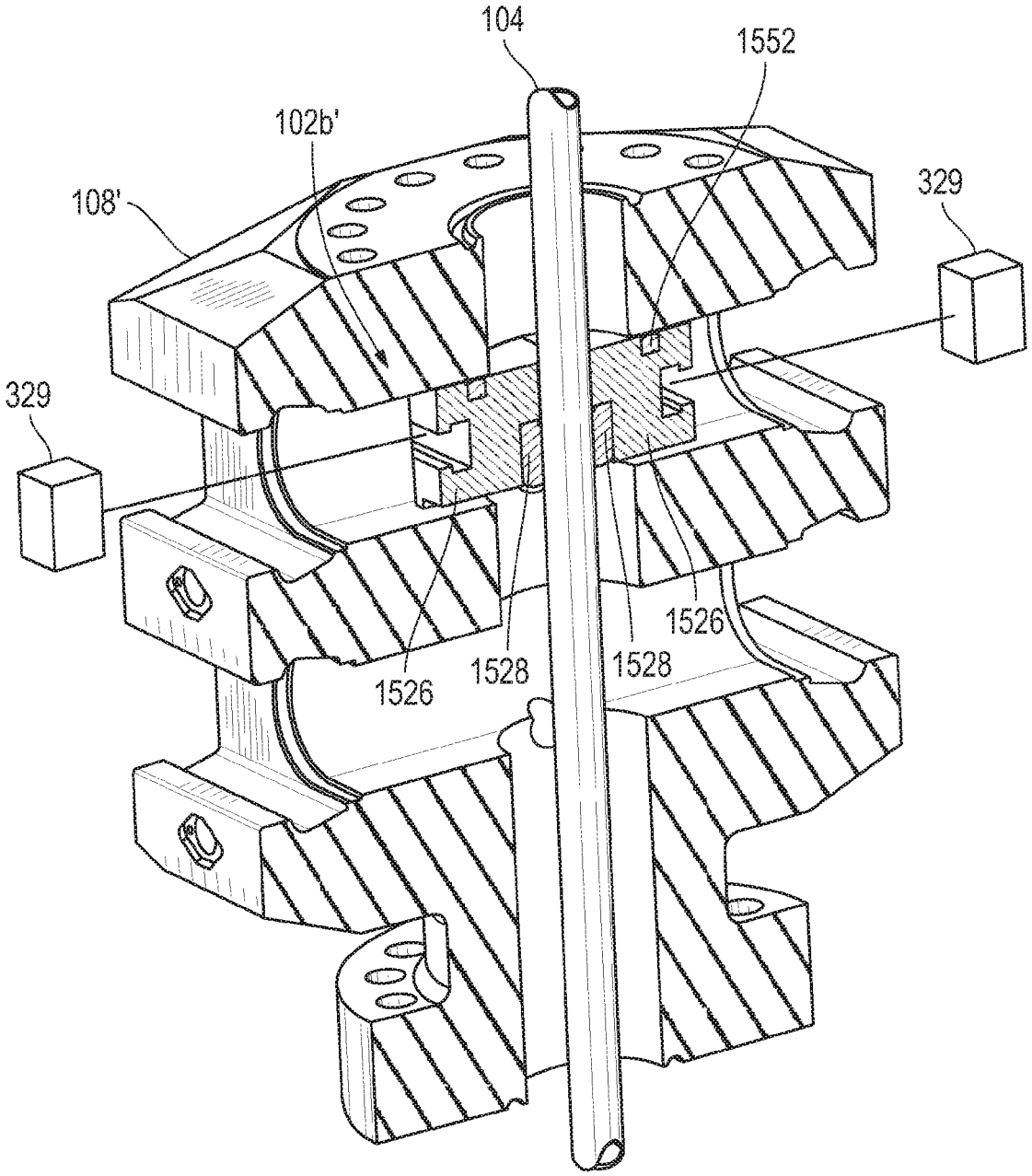
Figure 16A:
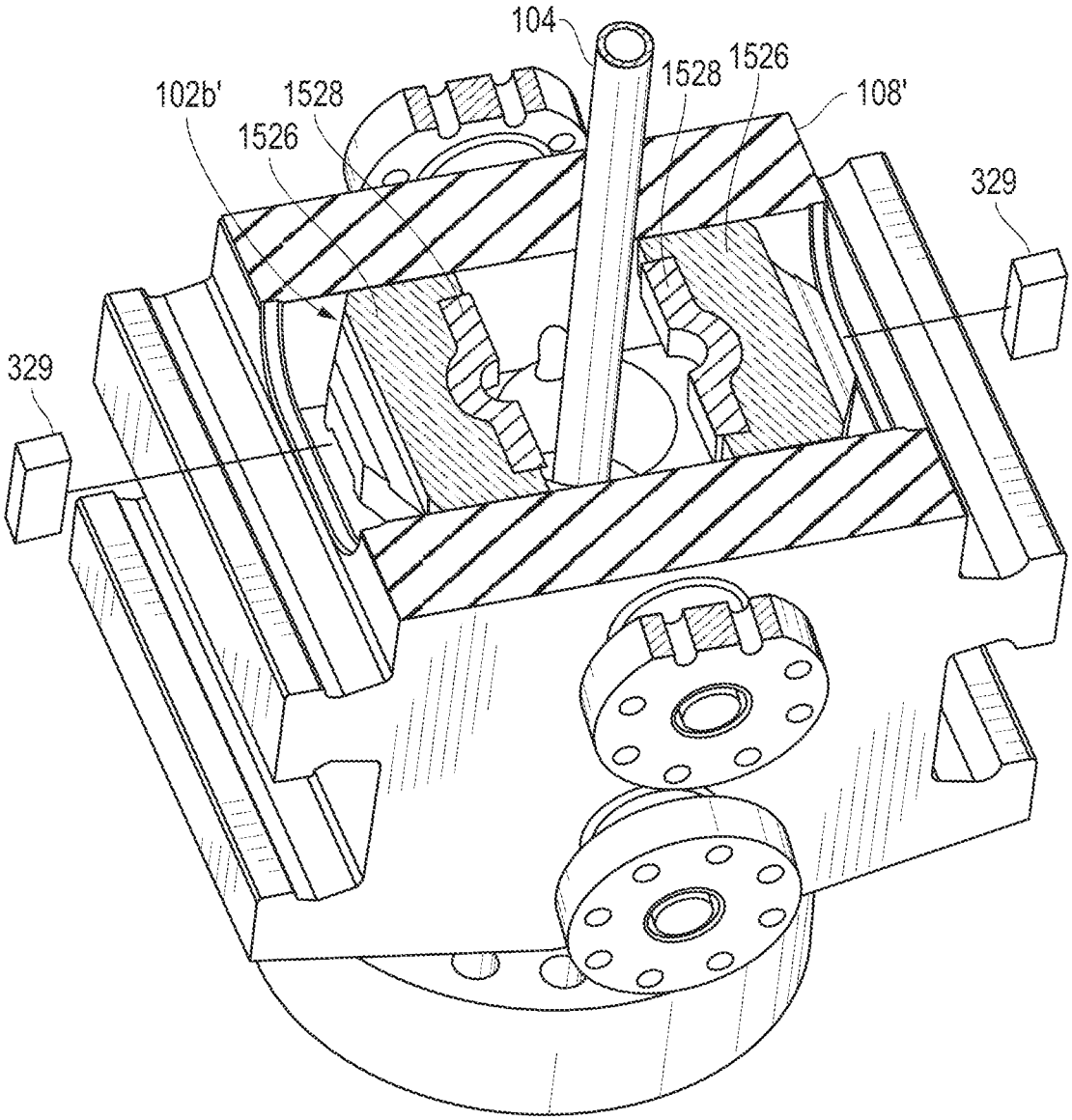
FIGS. 16A-16C show horizontal cross-sectional views of the BOP of FIG. 14 taken along line 16-16.
Figure 16B:
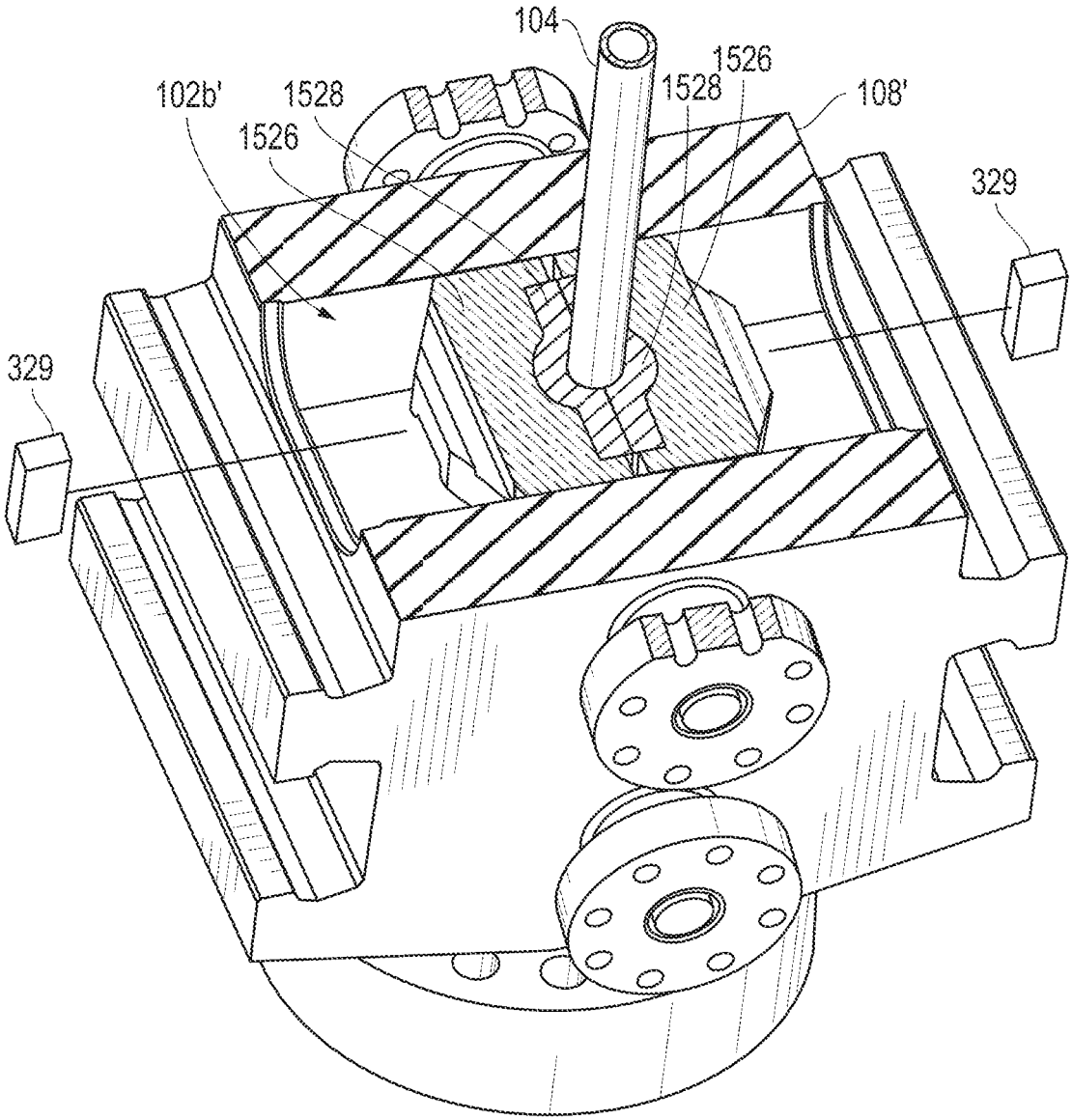
Figure 16C:
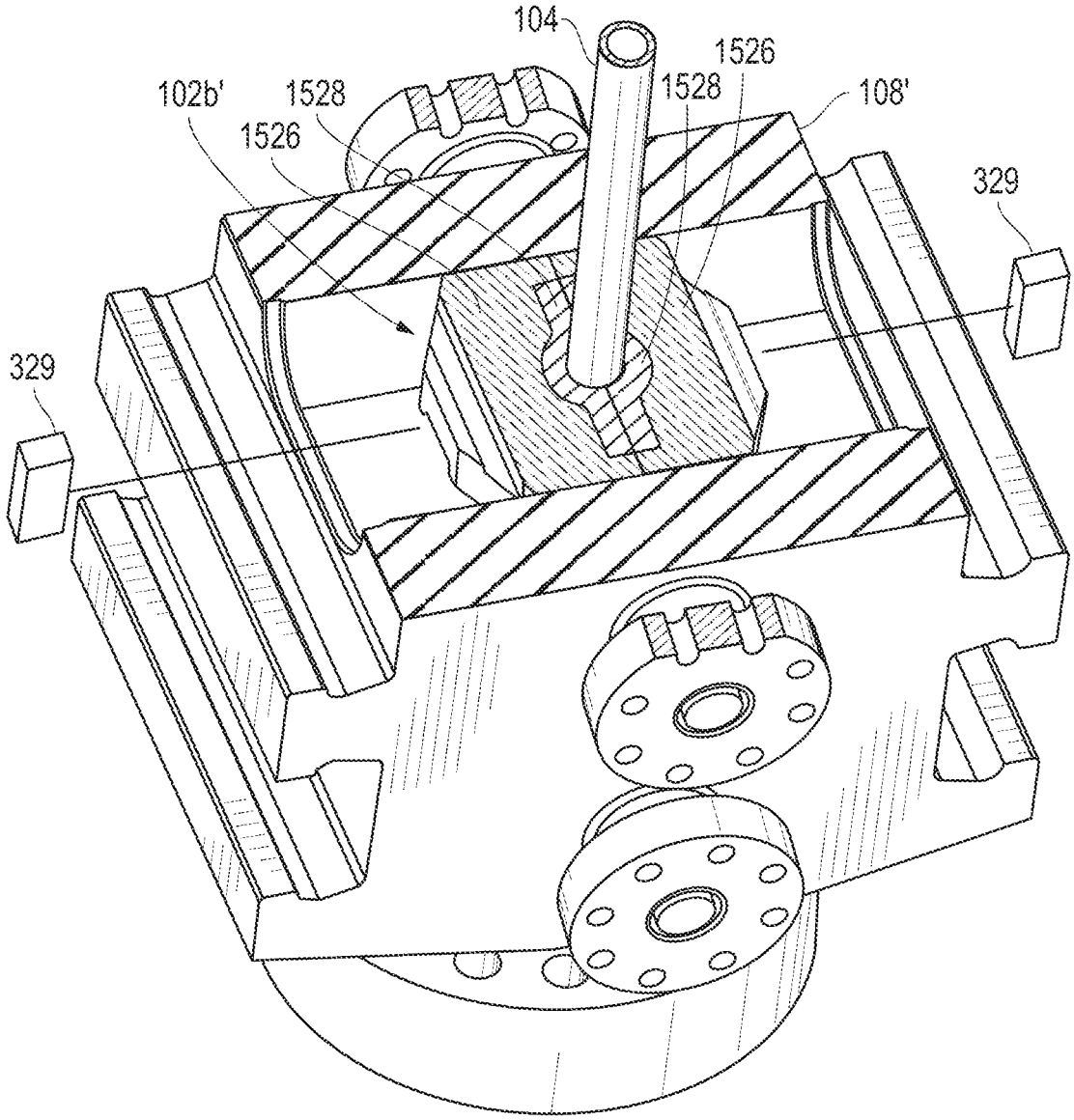

As shown in FIGS. 15A-15C and 16A-16C, the blocks 1526 are slidably movable within the BOP 108' between a non-contact position as shown in FIGS. 15A and 16A, and a face-to-face contact position as shown in FIGS. 15C and 16C. The static pipe seal 1528 is positioned in the blocks 1526 and carried thereby. In an intermediate position of FIGS. 15B and 16B, the static pipe seals 1528 of each block meet, and are then pressed together to permit the blocks 1526 to move to the face-to-face contact position of FIGS. 15C and 16C. One or more actuators 329 may be provided for selectively activating the blocks 1526 in the same manner as the blocks 326 and/or 926 as described herein.

A surface seal 1552 may be provided in each block 1526 for sealing with the BOP 108'. The blocks 1526 have a cavity 1527 for receiving the surface seal 1552 and preferably engage the BOP 108' to form a seal between the BOP 108' and the blocks 1526. The surface seal 1552 preferably prevent leakage of fluid from the pipe 104 and between the BOP 108' and a top side of the blocks 1526.

Figure 17A:
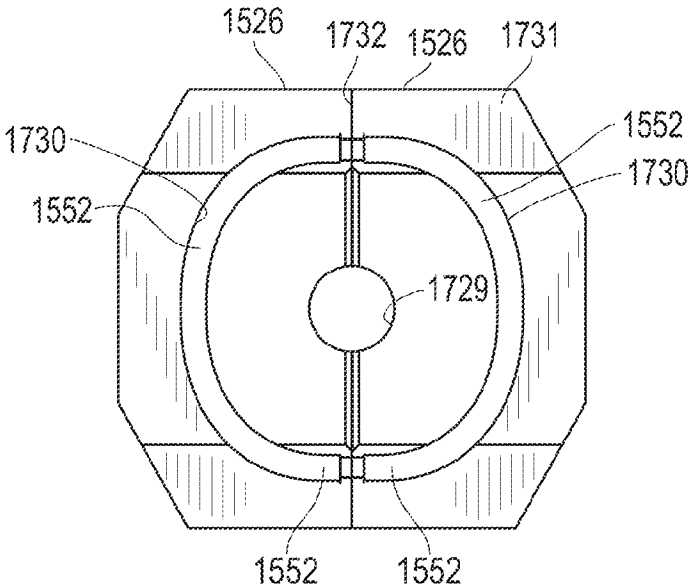
FIGS. 17A-17C show top, side and end views, respectively, of the ram blocks of FIG. 16C.
Figure 17B:
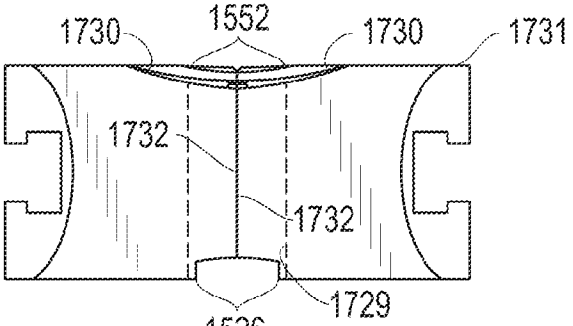
Figure 17C:
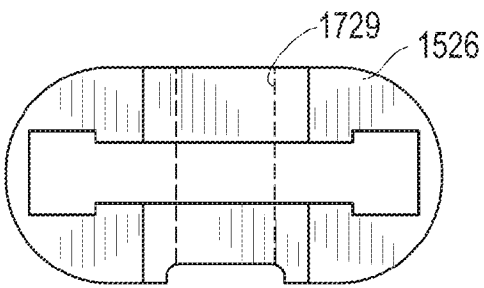
Figure 18A:
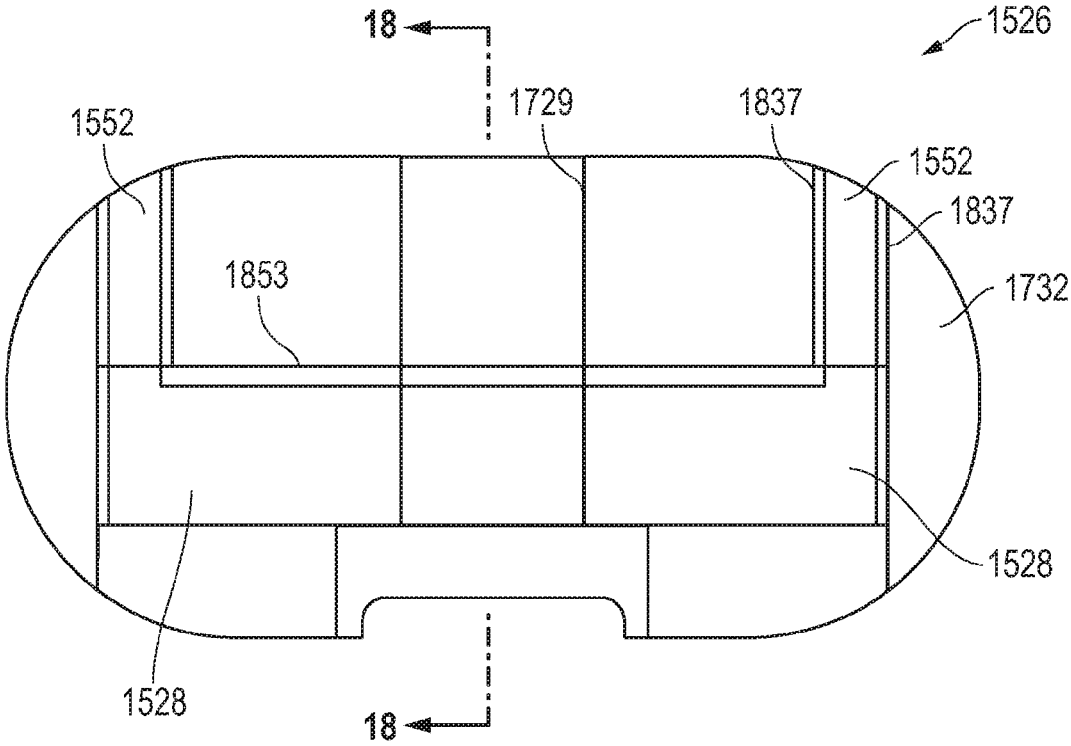
FIGS. 18A-18B are detailed views of one of the ram blocks of FIG. 17A.
Figure 18B:
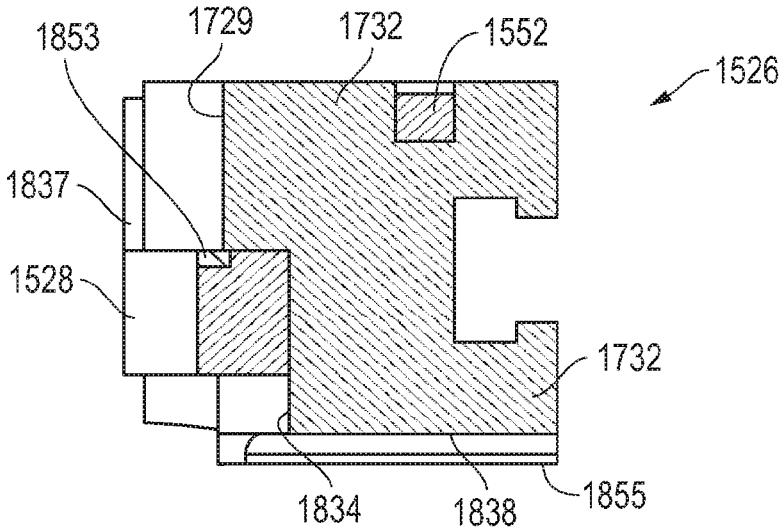

The blocks 1526 are shown in greater detail in FIGS. 17A-17C (also shown in FIGS. 15A-15C and 16A-16C). FIGS. 17A-17C show top, plan and outer side views, respectively, of the blocks 1526 in the face-to-face contact position. As shown in the top view of FIG. 17A, the pair of blocks 1526 have an octagonal shape when put together, an inlet 1729 therein and a channel 1730 therein is preferably provided. However, it will be appreciated that two or more blocks 1526 may be provided with a variety of shapes movable within the BOP 108'.

The blocks 1526 each have a contact surface 1732 that is preferably flat for face-to-face engagement therebetween. The inlet 1729 extends through each contact surface 1732 on each block 1526. This configuration provides positive touching of the blocks 1526 along contact surfaces 1732 of adjacent blocks 1526. As shown in FIGS. 17A and 17B, the contact surfaces 1732 preferably meet and are pressed against each other. In this position, the blocks 1526 surround the pipe 104 which is positioned in the inlets 1729 (see, e.g., FIGS. 15A-C).

In the contact position as shown, the inlets 1729 of the blocks 1526 form a hole configured to receive the pipe 104 (see FIGS. 1 and 2). Also in the contact position as shown, the channels 1730 of the blocks 1526 form a continuous (and in this case circular) channel therein along a top surface 1731 of the blocks 1526. The surface seal 1552 is positionable in the channel 1730. The channels 1730 are preferably configured for receiving the surface seal 1552. The surface seal 1552 as shown is a semi-oval member positionable in the channel 1730. As shown, for example, in FIG. 15C, the surface seal 1552 is positionable in the cavity 1527 to form a seal with the BOP 108' to prevent fluid from passing between the blocks 1526 and the BOP 108 adjacent thereto.

FIGS. 18A and 18B are detailed views of one of the blocks 1526 (also shown in FIGS. 15A-15C, 16A-16C and 17A-17C). FIG. 18A shows a plan view of the contact surface 1732 of the blocks 1526 with the surface seal 1552 and the static pipe seal 1528 therein. FIG. 18B is a cross-sectional view of block 1526 of FIG. 18A taken along line 18-18. The contact surface 1732 has the inlet 1729 extending therethrough. The cavity 1834 extends through the contact surface 1732 and into the block 1526 about inlet 1729. The cavity 1834 also extends through a bottom surface 1838. Cavity 1834 is configured to receive the static pipe seal 1528. The static pipe seal 1528 is preferably positionable in cavity 1834 for sealing engagement with the pipe 104 when the blocks 1526 are in the contact position as shown in FIGS. 15C and 16C.

The static pipe seal 1528 is positioned in cavity 1834 for sealing engagement with pipe 104. As shown, the static pipe seal 1528 is positioned in a top portion of cavity 1834 and does not fill the entire cavity. While the static pipe seal 1528 may be sized to fill cavity 1834, cavity 1834 is preferably defined to receive pipe seal 1528 with additional space to permit deformation of the pipe seal 1528 within the cavity 1834. The cavity 1834 is preferably open through the bottom surface 1838 to permit the static pipe seal 1528 to flow therethrough when pipe 104 is pressed against the pipe seal 1528.

Like the seal assemblies 102*a* and 102*b*, the seal assembly 102*b*' is preferably configured to prevent damage to the surface seal 1552 and/or static pipe seal 1528. Preferably, the blocks as shown in FIG. 18B, an anti-extrusion ring 1853 is provided in static pipe seal 1528. The anti-extrusion ring 1853 preferably prevents the static pipe seal 1528 from flowing into the inlet 1729 adjacent contact surface 1732. The static pipe seal 1528 is permitted to flow from cavity 1834 and out opening 1855 therein as the blocks 1526 are moved into the contact position of FIGS. 15C and 16C. An anti-extrusion plate 1837 may also be provided to further prevent the seal from flowing between the blocks 1526.

Blocks 1526 are activated to move from the retracted position of FIGS. 15A and 16A to the face-to-face contact position of FIGS. 15C and 16C with the static pipe seal 928 positioned therein as shown herein. In order to prevent damage to surface seals 1552 and static pipe seal 1528, it is further preferable that such seals remain recessed within depression 1530 and cavity 1834, respectively, until the blocks 926 are moved to the contact position. Once moved, the seals 1552, 1528 may flow in cavity 1834 (and out the bottom of block 1526 if needed) and about the blocks 1526 and/or pipe 104 as they are compressed.

As shown in FIGS. 15A and 16A, the pipe seals 1528 are positioned in the cavity 1834 as the blocks 1526 move to the contact position of FIGS. 15C and 16C. This unconfined configuration and/or activation preferably permits the seals 1552 and 1528 to flow out of the blocks 1526 as pressure is applied thereto. As the blocks are pressed together, the static pipe seal 1528 is preferably prevented from flowing between the blocks 1526, but is permitted to flow out opening 1855. This unconfined configuration allows the blocks 1526 to receive a boost force applied thereto during activation to reduce the pressure on the seals, and also preferably reduces pressure on the seals 1528 and the strain on the blocks 1526.

The actuator 329 and wellbore pressure outside the blocks 1526 apply a force to the blocks 1526 as they are pressed together. In the face-to-face contact position of FIGS. 15C and 16C, the blocks 1526 are permitted to press together to distribute force therebetween. To permit the face-to-face contact position, it is preferable that the pipe seals 1528 are prevented from extending between the blocks 1526. By allowing the pipe seals 1528 to flow out the cavity 1834, forces applied to the pipe seal 1528 are permitted to exit the blocks 1526. Preferably, the pipe seals 1528 are permitted to flow out of the blocks 1526 to prevent forces applied to the blocks 1526 from damaging the blocks.

Preferably, the pipe seal is configured to withstand ultra high pressure of about 30,000 psi (206.84 MPa) or more of wellbore pressure, as well as lower pressures. For the static seal assembly 102*b*', the rubber of the seals therein is preferably allowed to flow where it needs to, and is not fully confined. This configuration is provided to reduce the rubber pressure which reduces the stress in the block that contains the rubber. The rubber pressure may be around, for example, the pressure of the wellbore fluid.

While the seal assemblies 102*a,b* and 102' are depicted in a specific configuration, it will be appreciated that the seal assemblies and/or BOP 108 may be inverted. Additional components, such as gaskets, locking arms or mechanisms and/or dynamic seals, may be used in combination with and/or incorporated into the static seal assembly for operation therewith. Various combinations of features of the static seal assembly and the dynamic seal assembly may be provided.

Figure 19:
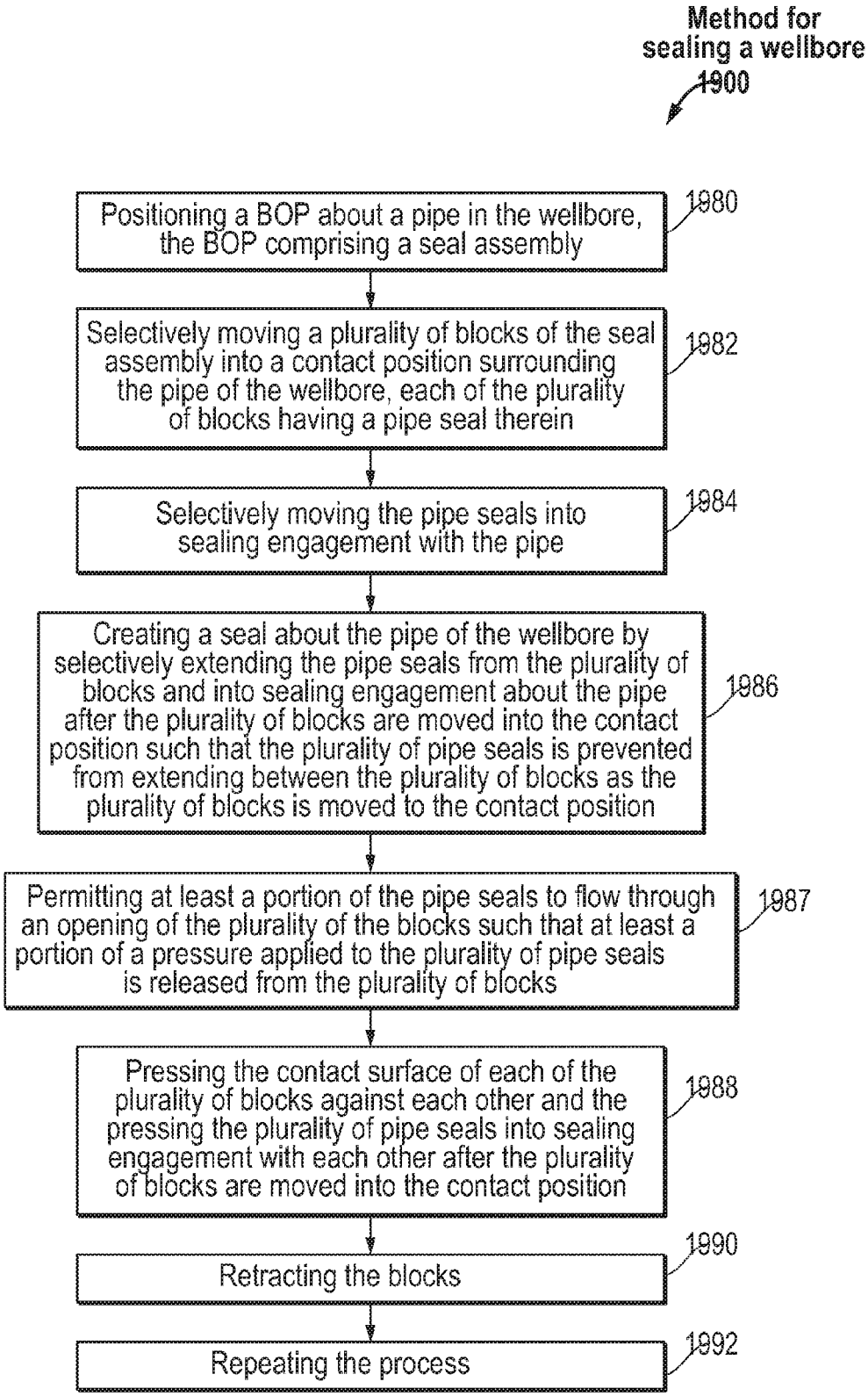
FIG. 19 is a flow chart depicting a method of sealing a wellbore.

FIG. 19 is a flowchart depicting a method 1900 of sealing a wellbore, such as the wellbore 104 of FIG. 1. The method involves positioning 1980 a BOP 108,108' about a pipe 104 in a wellbore 105. The BOP 108, 108' has a seal assembly 102 therein also positionable about the pipe 104. The seal assembly 102 may be a dynamic seal assembly 102*a* comprising blocks 326 with dynamic pipe seals 328 therein. Alternatively, the seal assembly 102 may be a static seal assembly 102*b, b'* comprising blocks 926, 1526 with static pipe seals 928, 1528 therein.

Actuators are used to selectively move 1982 blocks 326, 926, 1526 of the seal assembly into the contact position surrounding the pipe of the wellbore. This movement may involve moving the blocks between a non-contact position (see, e.g., FIGS. 3A, 4A, 9A, 10A, 15A, 16A) and a face-to-face contact position (see, e.g., FIGS. 3B, 3C, 4B, 4C, 9B, 10B, 15C, 16C). The actuators may also be used to selectively move 1984 the pipe seals into sealing engagement with the pipe.

For dynamic seal assemblies 102*a*, a seal is created 1984 about the pipe by selectively extending the pipe seals 328, 928, 1528 from the blocks and into sealing engagement about the pipe after the plurality of blocks are moved into the contact position such that the plurality of pipe seals is prevented from extending between the plurality of blocks as the plurality of blocks are moved into the contact position.

For static seal assemblies 102*b,b'* the blocks 926, 1526 each have an opening extending into a cavity therein and a pipe seal 928, 1528 therein. The pipe seals are pressed 1986 into sealing engagement with the pipe by selectively moving the plurality of blocks therein into a contact position surrounding the pipe of the wellbore. When the blocks 926, 1526 are in the contact position, 1987 the static pipe seals 928, 1528 may be permitted to flow through the opening of the plurality of blocks such that at least a portion of a pressure applied to the plurality of pipe seals is released from the plurality of blocks.

The contact surfaces of each of the plurality of blocks are pressed 1988 against each other and the pressing the plurality of pipe seals into sealing engagement with each other after the plurality of blocks are moved into the contact position. The blocks may be retracted 1990, and the process repeated 1992 as desired.

Additional steps may also be performed, such as measuring parameters, such as pressure, force, deflection and other parameters relating to the seal assembly 102, analyzing data and adjusting wellbore operations based on the measured parameters.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, interne, satellite, etc.) network.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in combination with other known BOPs, rams, actuators and/or seals. All such similar variations apparent to those skilled in the art are deemed to be within the scope of the invention as defined by the appended claims.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A seal assembly for sealing a wellbore, the wellbore having a pipe therein for passage of fluid therethrough and a blowout preventer (BOP) receiving the pipe therethrough, the seal assembly comprising:

a plurality of blocks positionable within the BOP, each of the plurality of blocks having an opening extending into a cavity therein;

at least one actuator for selectively moving the plurality of blocks to a contact position surrounding the pipe of the wellbore; and a plurality of pipe seals carried by the plurality of blocks for creating a seal about the pipe of the wellbore, the plurality of pipe seals being positionable in the cavity of the plurality of blocks and flowable through the opening thereof whereby at least a portion of a pressure applied to the plurality of pipe seals is released from the plurality of blocks.

2. The seal assembly of claim 1, further comprising a plurality of dynamic pipe seals for creating a seal about the pipe of the wellbore, the plurality of dynamic pipe seals carried by the plurality of blocks and selectively extendable therefrom for sealing engagement about the pipe after the plurality of blocks is moved to the contact position whereby the plurality of dynamic pipe seals is prevented from extending between the plurality of blocks as the plurality of blocks is moved to the contact position.

3. The seal assembly of claim 2, wherein each of the plurality of pipe seals comprises a face seal supported by a base, the face seal adapted to receive the pipe for sealing engagement therewith.

4. The seal assembly of claim 3, wherein the plurality of pipe seals further comprises a drive shaft operatively connectable to the base for selective extension thereof.

5. The seal assembly of claim 3, wherein each of the plurality of pipe seals comprises at least one seal support in the face seal for providing support thereto.

6. The seal assembly of claim 5, wherein the at least one seal support comprises a plurality of interlocking segments.

7. The seal assembly of claim 2, further comprising at least one locking arm for securing at least one of the plurality of pipe seals in a desired position.

8. The seal assembly of claim 7, wherein the at least one locking arm is carried by at least one of the plurality of pipe seals and is selectively extendable therefrom, the at least one locking arm extendable into a corresponding at least one pocket in the BOP.

9. The seal assembly of claim 1, wherein the opening of the plurality of blocks extends through a bottom surface thereof, each of the plurality of pipe seals flowable from the cavity and through the opening in the bottom surface.

10. The seal assembly of claim 1, further comprising an anti-extrusion ring for preventing each of the plurality of pipe seals from flowing between the plurality of blocks.

11. The seal assembly of claim 1, further comprising an anti-extrusion plate for preventing each of the plurality of pipe seals from flowing between the plurality of blocks.

12. The seal assembly of claim 1, further comprising at least one surface seal for creating a seal between the plurality of blocks and the BOP.

13. The seal assembly of claim 12, wherein each of the plurality of blocks has a channel for receiving the at least one surface seal.

14. The seal assembly of claim 13, wherein at least a portion of the channel is in a top surface of the plurality of blocks.

15. The seal assembly of claim 14, wherein a portion of the channel is in a contact surface of the plurality of blocks.

16. The seal assembly of claim 12, wherein each of the plurality of blocks has a depression in a top surface thereof for receiving the at least one surface seal.

17. The seal assembly of claim 16, further comprising an adapter positionable in the depression for sealing engagement with the at least one surface seal when the plurality of blocks is moved to the contact position.

18. A system for sealing a wellbore, the wellbore having a pipe therein for the passage of fluid therethrough, the system comprising:

a BOP receiving the pipe therethrough; and at least one seal assembly positionable about the BOP, each of the at least one seal assemblies comprising:

a plurality of blocks positionable within the BOP, each of the plurality of blocks having an opening extending into a cavity therein;

at least one actuator for selectively moving the plurality of blocks to a contact position surrounding the pipe of the wellbore; and a plurality of pipe seals carried by the plurality of blocks for creating a seal about the pipe of the wellbore, the plurality of pipe seals being positionable in the cavity of the plurality of blocks and flowable through the opening thereof whereby at least a portion of a pressure applied to the plurality of pipe seals is released from the plurality of blocks.

19. The system of claim 18, further comprising an adapter positionable between the at least one seal assembly and the BOP.

20. The system of claim 19, wherein each of the plurality of blocks has a depression therein for receiving the adapter.

21. The system of claim 20, wherein the at least one seal assembly further comprises a surface seal positionable in the depression between each of the plurality of blocks and the adapter for creating a seal therebetween.

22. The system of claim 18, wherein the at least one seal assembly comprises a plurality of seal assemblies, the plurality of seal assemblies activatable simultaneously.

23. The system of claim 18, wherein the at least one seal assembly comprises a plurality of seal assemblies, the plurality of seal assemblies activatable independently.

24. The system of claim 18, further comprising at least one dynamic pipe seal.

25. The system of claim 18, wherein the at least one seal assembly further comprises a surface seal.

26. The system of claim 18, further comprising at least one controller for selectively activating the at least one actuator.

27. A method for sealing a wellbore, the wellbore having a pipe therein for the passage of fluid therethrough, the method comprising:

positioning the pipe through a BOP, the BOP having a seal assembly therein comprising a plurality of blocks, each of the plurality of blocks having an opening extending into a cavity therein and a pipe seal in each cavity;

pressing the pipe seals into sealing engagement with the pipe by selectively moving the plurality of blocks therein to a contact position surrounding the pipe of the wellbore; and permitting at least a portion of the pipe seals to flow through the opening of the plurality of the blocks such that at least a portion of a pressure applied to the plurality of pipe seals is released from the plurality of blocks.

28. The method of claim 27, wherein each of the plurality of blocks has a dynamic pipe seal therein, and wherein the method further comprises creating a seal about the pipe of the wellbore by selectively extending the dynamic pipe seals from the plurality of blocks and into sealing engagement about the pipe after the plurality of blocks are moved into the contact position such that the dynamic pipe seals are prevented from extending between the plurality of blocks as the plurality of blocks is moved to the contact position.

29. The method of claim 28, further comprising locking the plurality of blocks in a desired position.

30. The method of claim 28, further comprising locking the dynamic pipe seal in a desired position.

31. The method of claim 28, further comprising selectively retracting the dynami pipe seals.

32. The method of claim 27, further comprising selectively moving the plurality of blocks to a non-contact position.

33. The method of claim 27, wherein the seal assembly further comprises a surface seal in a contact surface of each of the plurality of blocks, the method further comprising sealing the plurality of blocks together.

34. The method of claim 27, wherein the seal assembly further comprises a surface seal in a top surface of each of the plurality of blocks, the method further comprising sealing the plurality of blocks with the BOP.

35. The method of claim 34, further comprising positioning an adapter in the BOP, the step of sealing the plurality of blocks comprising sealing the plurality of blocks with the adapter via the surface seal.

36. The method of claim 27, further comprising preventing the pipe seals from extending between the plurality of blocks.

* * * * *